US011945071B2

(12) United States Patent
Sato

(10) Patent No.: US 11,945,071 B2
(45) Date of Patent: Apr. 2, 2024

(54) POLISHING BRUSH AND POLISHING METHOD

(71) Applicants: XEBEC TECHNOLOGY CO., LTD., Tokyo (JP); TAIMEI CHEMICALS CO., LTD., Nagano (JP)

(72) Inventor: Koji Sato, Tokyo (JP)

(73) Assignees: XEBEC TECHNOLOGY CO., LTD., Tokyo (JP); TAIMEI CHEMICALS CO., LTD., Nagano (JP)

( * ) Notice: Subject to any disclaimer, the term of this patent is extended or adjusted under 35 U.S.C. 154(b) by 0 days.

(21) Appl. No.: 18/001,261

(22) PCT Filed: May 7, 2021

(86) PCT No.: PCT/JP2021/017425

§ 371 (c)(1),
(2) Date: Dec. 8, 2022

(87) PCT Pub. No.: WO2022/004124

PCT Pub. Date: Jan. 6, 2022

(65) Prior Publication Data

US 2023/0241743 A1 Aug. 3, 2023

(30) Foreign Application Priority Data

Jul. 1, 2020 (JP) ..... 2020-113922

(51) Int. Cl.

| | |
|---|---|
| ***B24B 29/00*** | (2006.01) |
| ***B24B 1/00*** | (2006.01) |
| ***B24B 9/04*** | (2006.01) |
| ***B24B 29/08*** | (2006.01) |

(52) U.S. Cl.

CPC ..... *B24B 29/005* (2013.01); *B24B 1/00* (2013.01); *B24B 9/04* (2013.01); *B24B 29/08* (2013.01)

(58) Field of Classification Search

CPC ..... B24B 29/005; B24B 29/08

See application file for complete search history.

(56) References Cited

FOREIGN PATENT DOCUMENTS

| | | | | |
|---|---|---|---|---|
| DE | 3116326 A | * | 11/1982 | ..... A46B 7/06 |
| DE | 3116326 A1 | | 11/1982 | |
| JP | S61-265104 A | | 11/1986 | |
| JP | 2001-321225 A | | 11/2001 | |
| JP | 2004-142042 A | | 5/2004 | |
| JP | 2004142042 A | * | 5/2004 | |

OTHER PUBLICATIONS

WIPO, International Search Report for International Application No. PCT/JP2021/017425, dated Jul. 13, 2021.

* cited by examiner

*Primary Examiner* — Jason L Vaughan
*Assistant Examiner* — Amanda Kreiling

(57) ABSTRACT

A polishing brush (1) includes a rod-shaped member (2) and a grinding element bundle (4) formed of a plurality of wire-shaped grinding elements (3). The rod-shaped member (2) has a holding hole (6) at a front portion (2*a*) to hold the grinding element bundle (4). The holding hole (6) has a bottom face (7) and a sleeve-shaped peripheral wall (8) extending from the bottom face (7) in an inclination direction (S). The grinding element bundle (4) has a seated portion (4*a*) seated in the holding hole (6) and a protruding portion (4*b*) protruding from an opening (6*a*) of the holding hole (6) in the inclination direction (S). The tip end of the protruding portion (4*b*) is located on the outside of the rod-shaped member (2) when viewed from the axis (L0) direction.

22 Claims, 22 Drawing Sheets

POLISHING BRUSH AND POLISHING METHOD

FIELD

The present invention relates to a polishing brush having a bundle of wire-shaped grinding elements, and a polishing method using the polishing brush.

BACKGROUND

A polishing brush having a grinding element bundle that is a bundle of wire-shaped grinding elements is described in Patent Literature 1. The polishing brush in this literature includes a brush-shaped grinder having a grinding element bundle, and a rod-shaped polishing device holding the brush-shaped grinder. The polishing device includes a holder to hold the brush-shaped grinder at its front end portion. The brush-shaped grinder held by the holder has the grinding element bundle protruding forward from a front end of a rod-shaped member. The protruding direction of the grinding element bundle is the axial direction of the polishing device.

CITATION LIST

Patent Literature

Patent Literature 1: Japanese Patent Application Laid-open No. 2004-142042

SUMMARY

Technical Problem

When the inner peripheral surface of a tube member is polished using the polishing brush described in Patent Literature 1, the grinding element bundle is inserted into the workpiece with the axis of the polishing device inclined relative to the tube axis of the tube member. The tip end of the grinding element bundle is thus brought into contact with the inner wall of the tube member. Here, when the polishing brush described in Patent Literature 1 is used to polish the depth of the inner peripheral surface of the tube member, the polishing device inclined relative to the tube axis interferes with the opening edge of the tube member, so that the tip end of the grinding element bundle is unable to reach the depth of the tube member.

In view of the above, an object of the present invention is to provide a polishing brush that can avoid interference with an opening edge of a tube member, for example, when polishing the inner peripheral surface of the tube member. A polishing method using such a polishing brush is also developed.

Solution to Problem

To solve the above problem, a polishing brush according to the present invention includes a grinding element bundle formed of a plurality of wire-shaped grinding elements, and a rod-shaped member. When a direction along an axis of the rod-shaped member is an axial direction, a direction orthogonal to the axis is a radial direction, a direction intersecting the axial direction and the radial direction is an inclination direction, and one side of the axial direction is a front side and the other side is a back side, the rod-shaped member has a holding hole at a front portion to hold the grinding element bundle. The holding hole has a bottom face, a sleeve-shaped peripheral wall extending from the bottom face in the inclination direction, and an opening facing one direction of the radial direction. The grinding element bundle has a seated portion seated in the holding hole, and a protruding portion protruding from the opening of the holding hole in the inclination direction. An inclination angle at which a hole axis of the holding hole intersects the axis is 45° or less. A tip end of the protruding portion is located outside of the rod-shaped member when viewed from the axial direction. In the present invention, the polishing brush may include one grinding element bundle.

According to the invention, the grinding element bundle is held in the holding hole extending in the inclination direction and protrudes in the inclination direction from the opening of the holding hole. In the grinding element bundle, the tip end of the protruding portion protruding from the holding hole is located on the outside of the rod-shaped member when viewed from the axial direction. Therefore, to polish an inner peripheral surface of a tube member, the tip end of the grinding element bundle can be brought into contact with the inner wall by setting the axis of the rod-shaped member parallel to the tube axis of the tube member, and inserting the grinding element bundle into the tube member. Here, when the axis of the rod-shaped member is set parallel to the tube axis of the tube member, the rod-shaped member does not interfere with the opening edge of the tube member. The holding hole for holding the grinding element bundle is provided at the front portion of the rod-shaped member. The back end portion of the rod-shaped member therefore can be connected to a machine tool. Thus, the rod-shaped member can be inserted deep into the tube member. The polishing brush thus can polish the depth of the inner peripheral surface of the tube member. The holding hole of the rod-shaped member for holding the grinding element bundle has the peripheral wall extending in the inclination direction. Therefore, when the grinding element bundle is held in the holding hole, the grinding element bundle can protrude in the inclination direction. Furthermore, when the inclination angle of the grinding element bundle is 45° or less, the grinding element bundle is easily flexed toward the axis when polishing the inner peripheral surface of the tube member. Thus, excessive polishing of the inner peripheral surface of the tube member by the tip end of the grinding element bundle can be prevented or suppressed.

In the present invention, the peripheral wall of the holding hole may have a peripheral wall portion facing the seated portion from inside in the radial direction with respect to the hole axis of the holding hole. In this way, when the tip end of the protruding portion of the grinding element bundle is brought into contact with the inner peripheral surface of the tube member to polish the inner peripheral surface of the tube member, the peripheral wall portion of the holding hole can limit the range of flexure of the grinding element bundle even when the grinding element bundle is flexed in a direction approaching the axis under the load applied to the grinding element bundle from the inner peripheral surface of the tube member. The grinding element bundle thus can maintain the polishing force to polish the inner peripheral surface of the tube member.

Here, if the entire region of the peripheral wall portion of the holding hole is in contact with the seated portion of the grinding element bundle, the grinding element bundle is easily broken from the portion abutting on the opening edge of the holding hole when the grinding element bundle is flexed under the load applied to the grinding element bundle from the inner peripheral surface of the tube member. To address this situation, in the present invention, it is preferable that an opening-side region with a predetermined width from the opening in the peripheral wall portion faces the seated portion with a gap. In this way, the grinding element bundle is allowed to flex inside the holding hole when load is applied to the grinding element bundle from the inner peripheral surface of the tube member. Thus, the breakage of the grinding element bundle from the portion abutting on the opening edge of the holding hole can be prevented or suppressed.

In the present invention, it is preferable that the polishing brush includes a grinding element bundle holder to hold an end opposite to the protruding portion of the seated portion, and the grinding element bundle is removably held in the holding hole with the grinding element bundle holder interposed. In this way, the brush-shaped grinder formed of the grinding element bundle holder and the grinding element bundle held by the grinding element bundle holder can be removable from the rod-shaped member. Therefore, when the grinding element bundle is worn due to polishing of the inner peripheral surface of the tube member, the brush-shaped grinder can be replaced with a new one.

In the present invention, the grinding element bundle holder may have a sleeve surrounding the end opposite to the protruding portion of the seated portion from an outer peripheral side, and a bottom closing one opening of the sleeve. The bottom may abut on the bottom face. The sleeve may be in contact with the peripheral wall portion on a side closer to the bottom face than the opening-side region. In this way, the bottom of the grinding element bundle holder holding the grinding element bundle is brought into abutment with the bottom face of the holding hole, so that the brush-shaped grinder can be held in the rod-shaped member. When the brush-shaped grinder is held in the holding hole, the exposed portion exposed from the sleeve in the holding hole in the grinding element bundle is spaced apart from the peripheral wall portion of the holding hole with a gap equal to the thickness of the sleeve. The brush-shaped grinder is simply held in the holding hole so that the opening-side region of the peripheral wall portion can be spaced apart from the seated portion.

In the present invention, it is preferable that the polishing brush includes a screw fixing mechanism to fix the grinding element bundle holder to the rod-shaped member in a non-rotatable manner around the hole axis of the holding hole. In this way, the inner peripheral surface of the tube member can be polished more precisely than when the brush-shaped grinder held in the holding hole rotates around the hole axis in the holding hole.

In this case, the sleeve may have a cylindrical shape, the bottom may have a disk-like shape. The screw fixing mechanism may include a fixing screw, a threaded hole penetrating the bottom in a direction orthogonal to the hole axis of the holding hole, and a fixing hole extending in the direction orthogonal to the hole axis of the holding hole in the rod-shaped member and penetrating from outside of the rod-shaped member to the holding hole. The fixing screw may be screwed into the threaded hole through the fixing hole and penetrate the bottom to abut on the peripheral wall. In this way, the brush-shaped grinder held in the holding hole can be fixed to the holding member in a non-rotatable manner around the hole axis of the holding hole. Since the threaded hole penetrates the grinding element bundle holder, the brush-shaped grinder can be rotated 180° around the hole axis and reused when the tip end of the grinding element bundle is worn due to polishing of the inner peripheral surface of the tube member. In other words, when the tip end of the grinding element bundle is worn, the fixing screw is removed from one opening of the threaded hole, the brush-shaped grinder is rotated 180° around the hole axis of the holding hole, and then the fixing screw is screwed into the threaded hole through the other opening of the threaded hole. With this operation, in the brush-shaped grinder, the surfaces facing radially outward in the grinding element bundle are changed. As a result, a less worn portion in the tip end of the grinding element bundle can be brought into contact with the inner peripheral surface of the tube member, enabling reuse of the brush-shaped grinder.

In the present invention, the sleeve may have a cylindrical shape, and the bottom may have a disk-like shape. The screw fixing mechanism may include a fixing screw, a threaded hole penetrating the bottom in a direction orthogonal to the hole axis of the holding hole, and a fixing hole extending in the direction orthogonal to the hole axis of the holding hole in the rod-shaped member and penetrating from outside of the rod-shaped member to the holding hole. The fixing screw may have a shaft with male threads on an outer peripheral surface to be screwed in the threaded hole, and a head at one end of the shaft. The shaft may be screwed into the threaded hole through the fixing hole. The head may abut on the rod-shaped member from an outer peripheral side. In this way, the brush-shaped grinder held in the holding hole can be fixed to the holding member in a non-rotatable manner around the hole axis of the holding hole. Since the threaded hole penetrates the grinding element bundle holder, the brush-shaped grinder can be rotated 180° around the hole axis and reused when the tip end of the grinding element bundle is worn due to polishing of the inner peripheral surface of the tube member. In other words, when the tip end of the grinding element bundle is worn, the fixing screw is removed from one opening of the threaded hole, the brush-shaped grinder is rotated 180° around the hole axis of the holding hole, and then the fixing screw is screwed into the threaded hole through the other opening of the threaded hole. With this operation, in the brush-shaped grinder, the surfaces facing radially outward in the grinding element bundle are changed. As a result, a less worn portion in the tip end of the grinding element bundle can be brought into contact with the inner peripheral surface of the tube member, enabling reuse of the brush-shaped grinder.

In the present invention, the sleeve may have a cylindrical shape. The screw fixing mechanism may include a fixing screw and a threaded hole extending in a direction orthogonal to the hole axis of the holding hole in the rod-shaped member. The threaded hole may have a connecting portion communicatively connected to the holding hole at a portion in a circumferential direction of the threaded hole. The fixing screw may have a protruding portion protruding into the holding hole from the connecting portion when the fixing screw is screwed into the threaded hole. The protruding portion of the fixing screw may abut on the sleeve from the opening side of the holding hole in the inclination direction. Even in this way, the brush-shaped grinder held in the holding hole can be fixed to the holding member in a non-rotatable manner around the hole axis of the holding hole. When the fixing screw is removed from the threaded hole, the abutment state of the protruding portion of the fixing screw with the sleeve of the grinding element bundle holder is released to enable the brush-shaped grinder to rotate at any angle around the hole axis. Therefore, when the tip end of the grinding element bundle is worn due to polishing of the inner peripheral surface of the tube member, the brush-shaped grinder is rotated around the hole axis so that a less worn portion in the tip end of the grinding element bundle can be brought into contact with the inner peripheral surface of the tube member. The brush-shaped grinder thus can be reused.

In the present invention, the rod-shaped member may have a small-diameter hole having an inner diameter smaller than the holding hole, the small-diameter hole extending linearly from the bottom face to a side opposite to the opening of the holding hole and penetrating the rod-shaped member. With such a small-diameter hole, the air in the holding hole can escape to the outside through the small-diameter hole when the brush-shaped grinder is held in the holding hole. The brush-shaped grinder therefore is easily held in the holding hole. The brush-shaped grinder can be pushed toward the opening of the holding hole by inserting a pin through the small-diameter hole to bring the pin into contact with the grinding element bundle holder abutting on the bottom face of the holding hole, and then projecting the tip end of the pin into the holding hole. The removal of the brush-shaped grinder is therefore easy.

In the present invention, the holding hole may have a second opening at a portion in a circumferential direction of an annular corner at which the peripheral wall and the bottom face intersect, the second opening communicatively connecting the holding hole to outside of the rod-shaped member. A holder corner including a portion in a circumferential direction of the bottom in the grinding element bundle holder may be exposed outward of the rod-shaped member through the second opening. With the second opening of the holding hole, the air in the holding hole can escape to the outside through the second opening when the brush-shaped grinder is held in the holding hole. The brush-shaped grinder therefore is easily held in the holding hole. When the brush-shaped grinder is held in the holding hole, the grinding element bundle holder can be visible through the second opening. Whether the brush-shaped grinder is reliably held in the holding hole therefore can be visually checked. Furthermore, the brush-shaped grinder can be pushed toward the opening of the holding hole by pushing the holder corner exposed outward of the rod-shaped member through the second opening in the grinding element bundle holder in the inclination direction. The removal of the brush-shaped grinder is therefore easy.

In this case, it is preferable that when viewed from an orthogonal direction perpendicular to a virtual plane including the axis and the hole axis of the holding hole, the rod-shaped member has a notch on a side opposite to the opening of the holding hole across the axis, the second opening is open inside of the notch, and the holder corner is located inside of the notch. In this way, when the polishing brush is inserted into the tube member, the holder corner of the grinding element bundle holder exposed outward of the rod-shaped member can be prevented from interfering with the opening edge of the tube member or the like.

In the present invention, the rod-shaped member may have a front opening disposed on the back side of the opening at the front portion of the rod-shaped member, a back opening disposed at a back end portion of the rod-shaped member, and an internal channel communicatively connecting the front opening and the back opening. In this way, air and/or coolant can be supplied from the back opening at the back portion of the rod-shaped member and provided toward the grinding element bundle through the internal channel.

In the present invention, the protruding portion may protrude to the front side from the opening of the holding hole. In this way, the protruding portion of the grinding element bundle extends to the front side, so that the tip end of the grinding element bundle can reach the depth of the tube member when polishing the inner peripheral surface of the tube member.

In this case, the rod-shaped member may have a recess on the back side of the opening at the front portion of the rod-shaped member when viewed from an orthogonal direction perpendicular to a virtual plane including the hole axis of the holding hole and the axis. A front end face of the rod-shaped member is parallel to the hole axis when viewed from the orthogonal direction. The recess may have an inclined surface inclined to a side at which the axis is located from the opening side toward the back side when viewed from the orthogonal direction. The front end face is parallel to the inclined surface. In this way, the rod-shaped member can be held in a predetermined posture by gripping a section between the front end face and the inclined surface in the rod-shaped member with a jig. The grinding element bundle is therefore easily held in the holding hole of the rod-shaped member gripped with a jig.

In the present invention, the protruding portion may protrude to the back side from the opening of the holding hole. In this way, the protruding portion of the grinding element bundle extends to the back side. Thus, for example, when the tube member has an annular step on the inner peripheral surface, the step can be polished from the depth side of the tube member by inserting the polishing brush into the tube member and placing the grinding element bundle deeper than the step.

In the present invention, when viewed from an orthogonal direction perpendicular to a virtual plane including the hole axis of the holding hole and the axis, an outside end of the grinding element bundle may be parallel to the axis. In this way, the tip end of the grinding element bundle can be brought into contact with the inner peripheral surface over a relatively large area when polishing the inner peripheral surface of the tube member.

In the present invention, the protruding portion may have a tip end with a conical shape tapered in the inclination direction toward the tip end. In this way, the tip end of the grinding element bundle can be brought into contact with the inner peripheral surface over a relatively large area when polishing the inner peripheral surface of the tube member. Here, since it is easy to form the tip end of the grinding element bundle into a conical shape, the production of the grinding element bundle with an inclined tip end is easy.

In the present invention, an inclination angle at which the hole axis of the holding hole intersects the axis may be 15° or more. When the inclination angle is 15° or more, the tip end of the grinding element bundle is easily brought into contact with the inner peripheral surface of the tube member located on the outer peripheral side of the rod-shaped member.

The present invention provides a polishing method of polishing an inner peripheral surface of a tubular portion in a workpiece using the polishing brush described above, in which the grinding element bundle is inserted into the tubular portion with the axis of the rod-shaped member set parallel to a tube axis of the tubular portion, and the workpiece is rotated around the tube axis with the grinding element bundle in contact with the inner peripheral surface.

Another aspect of the present invention provides a polishing method of polishing an inner peripheral surface of a tubular portion in a workpiece using the polishing brush described above, in which the grinding element bundle is inserted into the tubular portion with the axis of the rod-shaped member set parallel to a tube axis of the tubular portion, and the workpiece is rotated around the tube axis with the grinding element bundle in contact with the inner peripheral surface.

Advantageous Effects of Invention

In the present invention, the holding hole for holding the grinding element bundle is provided at the front portion of the rod-shaped member. When the axis of the rod-shaped member is set parallel to the tube axis of the tube member to be polished, the rod-shaped member does not interfere with the opening edge of the tube member. Thus, the rod-shaped member can be inserted deep into the tube member. The polishing brush thus can polish the depth of the inner peripheral surface of the tube member. The grinding element bundle can be flexed when the tip end of the protruding portion of the grinding element bundle is brought into contact with the inner peripheral surface of the tube member to polish the inner peripheral surface of the tube member. The grinding element bundle therefore can maintain the polishing force to polish the inner peripheral surface of the tube member.

DESCRIPTION OF EMBODIMENTS

A polishing brush according to embodiments of the present invention will be described below with reference to the drawings.

First Embodiment

Figure 1:
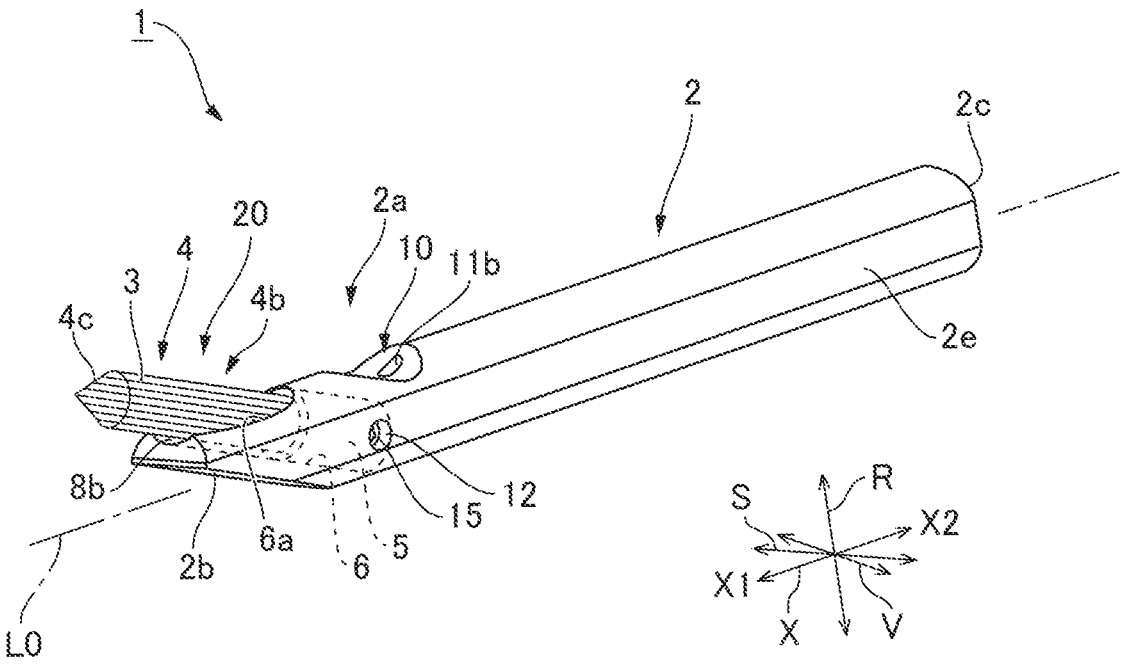
FIG. 1 is a perspective view of a polishing brush viewed from the side at which a grinding element bundle protrudes.
Figure 2:
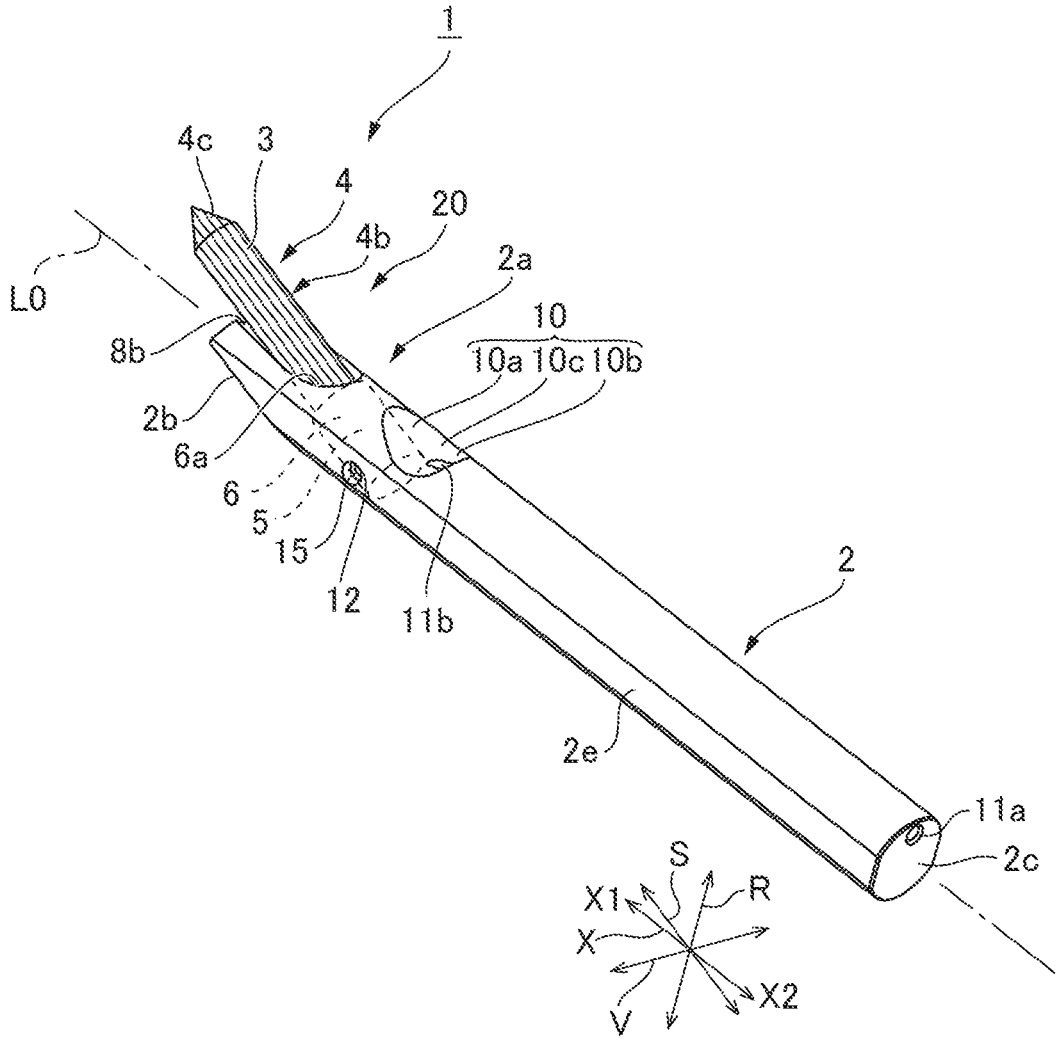
FIG. 2 is a perspective view of the polishing brush viewed from the back side.
Figure 3:
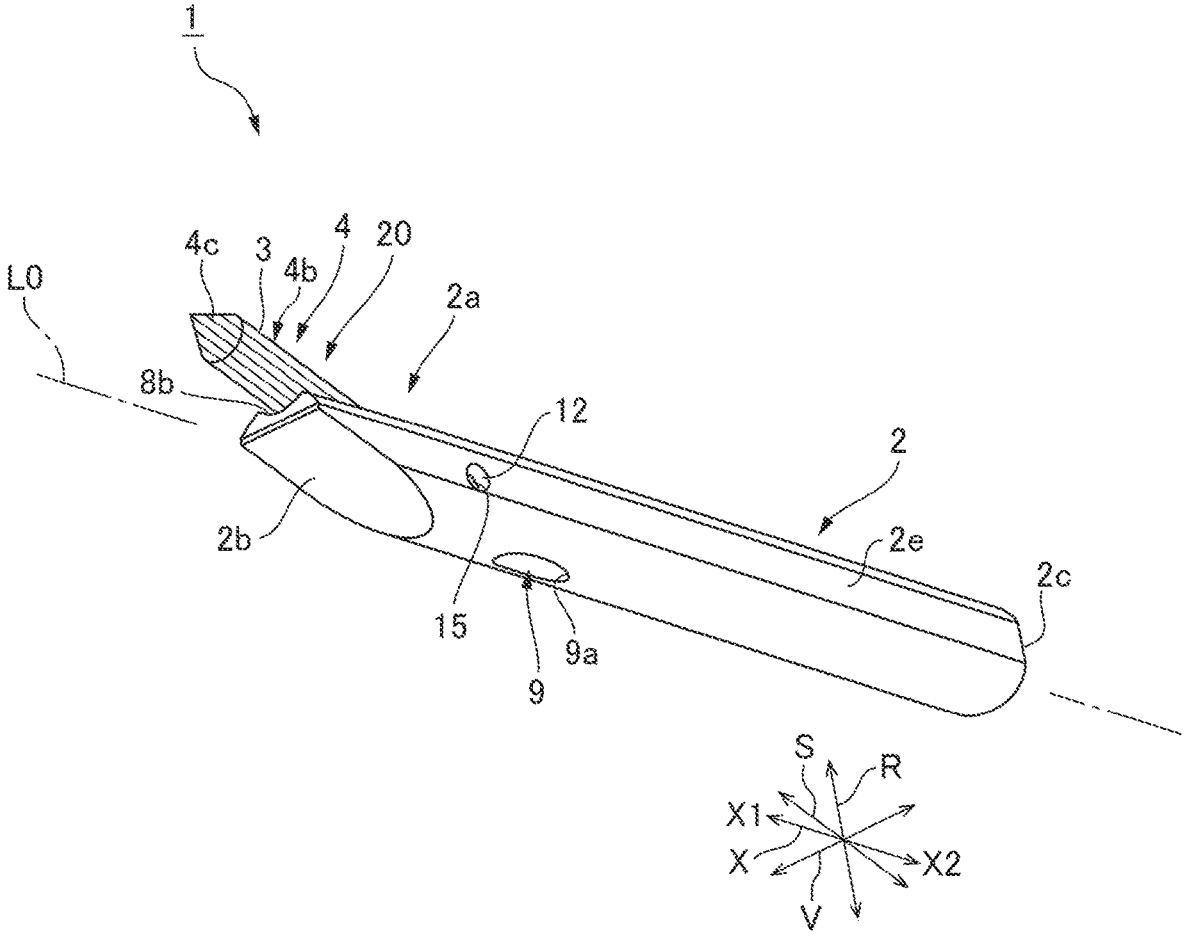
FIG. 3 is a perspective view of the polishing brush viewed from the side opposite to the grinding element bundle.
Figure 4:
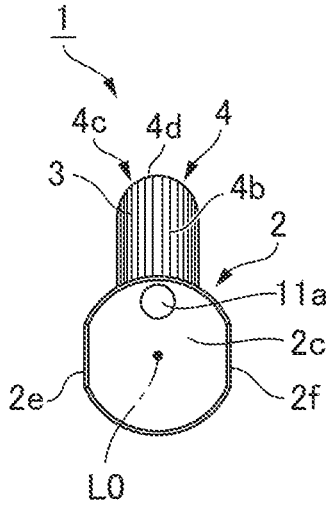
FIG. 4 is a rear view of the polishing brush.
Figure 5:
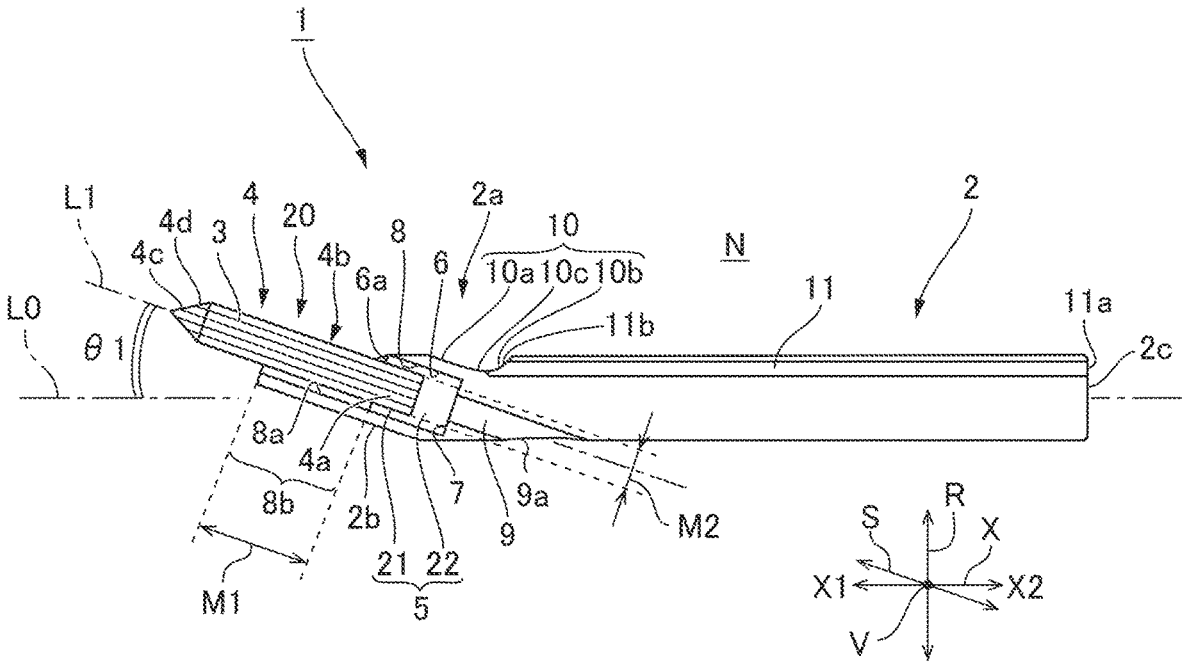
FIG. 5 is a cross-sectional view of the polishing brush cut along the axis of a rod-shaped member.
Figure 6:
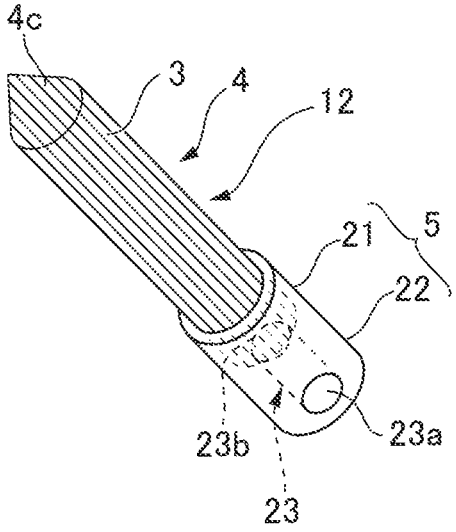
FIG. 6 is a perspective view of a brush-shaped grinder.

FIG. 1 is a perspective view of a polishing brush viewed from the side at which a grinding element bundle protrudes. FIG. 2 is a perspective view of the polishing brush viewed from the back side. FIG. 3 is a perspective view of the polishing brush viewed from the side opposite to the side at which the grinding element bundle protrudes. FIG. 4 is a rear view of the polishing brush. FIG. 5 is a cross-sectional view of the polishing brush cut along the axis of a rod-shaped member and the hole axis of a holding hole. FIG. 6 is a perspective view of a brush-shaped grinder.

A polishing brush 1 in the present embodiment is used in polishing work for polishing the inner peripheral surface of a workpiece that is a tube member or in polishing work for polishing the inner peripheral surface of a tubular portion of a workpiece. The workpiece is, for example, a metal cast. The polishing brush 1 is coupled to the head of a not-illustrated machine tool to be used. The head of a machine tool is, for example, the spindle head of a machining center. The head of a machine tool is, for example, the tool post of an NC turret lathe.

As illustrated in FIG. 1 to FIG. 3, the polishing brush 1 includes a rod-shaped member 2 and a grinding element bundle 4 formed of a plurality of wire-shaped grinding elements 3. The grinding element bundle 4 is held in a holding hole 6 provided in the rod-shaped member 2. As illustrated in FIG. 5, the grinding element bundle 4 has a seated portion 4*a* seated in the holding hole 6, and a protruding portion 4*b* protruding from an opening 6*a* of the holding hole 6. The protruding portion 4*b* is inclined relative to the axis L0 of the rod-shaped member 2.

Here, the grinding element bundle 4 is held by a grinding element bundle holder 5 at an end opposite to the protruding portion 4*b* in the seated portion 4*a*. The grinding element bundle 4 is therefore held in the holding hole 6 with the grinding element bundle holder 5 interposed. The grinding element bundle 4 and the grinding element bundle holder 5 constitute a brush-shaped grinder 20. Thus, it can be said that the rod-shaped member 2 holds the brush-shaped grinder 20 in the holding hole 6. The brush-shaped grinder 20 is removably held in the rod-shaped member 2.

In the following description, the direction along the axis L0 of the rod-shaped member 2 is referred to as the axial direction X. One side of the axial direction X is referred to as front side X1 and the other side is referred to as back side X2. Furthermore, the direction orthogonal to the axis L0 is referred to as radial direction R. The direction intersecting the axial direction X and the radial direction R and in which the grinding element bundle 4 is inclined is referred to as inclination direction S. The holding hole 6 is therefore provided at a front portion 2*a* of the rod-shaped member 2. A back end portion of the rod-shaped member 2 is chucked to the head of a machine tool. In the present embodiment, the protruding portion 4*b* of the grinding element bundle 4 extends from the opening 6*a* of the holding hole 6 toward the front side X1. As illustrated in FIG. 4, when viewed from the axial direction X, a tip end 4*c* of the protruding portion 4*b* is located on the outer peripheral side from the rod-shaped member 2.

(Rod-Shaped Member)

The rod-shaped member 2 has a cylindrical shape as a whole. As illustrated in FIG. 4, the rod-shaped member 2 has a pair of flat portions 2*e* and 2*f* on both sides with the axis L0 therebetween. The pair of flat portions 2*e* and 2*f* each extend in the axial direction X with a constant width. The rod-shaped member 2 does not have a portion protruding to the outer peripheral side from a back end face 2*c* of the rod-shaped member 2 when viewed from the back side X2.

As illustrated in FIGS. 1, 2, and 5, the holding hole 6 is located between the pair of flat portions 2*e* and 2*f* in the circumferential direction. As illustrated in FIG. 5, the holding hole 6 has a bottom face 7 and a sleeve-shaped peripheral wall 8 extending from the bottom face 7 in the inclination direction S. The bottom face 7 is orthogonal to the inclination direction S. The end of the peripheral wall 8 on the side opposite to the bottom face 7 is the opening 6*a* of the holding hole 6. The opening 6*a* is located on the front side X1 with respect to the bottom face 7. The inner diameter size of the peripheral wall 8 is constant.

The centerline of the peripheral wall 8 is the hole axis L1 of the holding hole 6. The hole axis L1 extends in the inclination direction S. The holding hole 6 therefore extends in the inclination direction S. Here, the inclination angle θ1 at which the hole axis L1 intersects the axis L0 of the rod-shaped member 2 is 15° or more and 45° or less. In the present embodiment, the inclination angle θ1 is 20°. The inclination angle θ1 is more preferably 20° or more and 30° or less.

As illustrated in FIG. 5, the rod-shaped member 2 has a small-diameter hole 9 having a diameter smaller than that of the holding hole 6 and extending linearly from the bottom face 7 of the holding hole 6 on the side opposite to the opening 6*a*. The small-diameter hole 9 penetrates the rod-shaped member 2. As illustrated in FIG. 3, the rod-shaped member 2 thus has an opening 9*a* of the small-diameter hole 9 on the side opposite to the opening 6*a* of the holding hole 6 across the axis L0. In the present embodiment, the small-diameter hole 9 and the holding hole 6 are coaxial.

A front end face 2*b* of the rod-shaped member 2 is a plane intersecting the axis L0. As illustrated in FIG. 5, the front end face 2*b* and the hole axis L1 are parallel when the rod-shaped member 2 is viewed from an orthogonal direction V perpendicular to a virtual plane N including the hole axis L1 and the axis L0.

The rod-shaped member 2 has a recess 10 on the back side X2 of the opening 6*a* at the front portion 2*a* of the rod-shaped member 2. When viewed from the orthogonal direction V, the recess 10 has a front inner wall 10*a* (inclined surface) inclined from the opening 6*a* side toward the back side X2 in a direction approaching the axis L0, a back inner wall 10*b* opposed to the front inner wall 10*a* on the back side X2 of the front inner wall 10*a* and inclined to the back side X2 toward the outer peripheral side, and a curved inner wall 10*c* connecting the back edge of the front inner wall 10*a* to the front edge of the back inner wall 10*b*. The front end face 2*b* of the rod-shaped member 2 is parallel to the front inner wall 10*a*.

The rod-shaped member 2 also has a back opening 11*a* at the back end face 2*c* of the rod-shaped member 2, a front opening 11*b* at the back inner wall 10*b* of the recess 10, and an internal channel 11 communicatively connecting the back opening 11*a* to the front opening 11*b*. The location of the back opening 11*a* is not limited to the back end face 2*c*. The back opening 11*a* may be provided on a surface facing radially outside at the back end portion of the rod-shaped member 2.

Furthermore, as illustrated in FIGS. 1, 2, and 3, the rod-shaped member 2 has a fixing hole 12 communicatively connected to the holding hole 6. The fixing hole 12 is provided at a middle portion between the front end face 2*b* of the rod-shaped member 2 and the front inner wall 10*a* of the recess 10 when viewed from the orthogonal direction V. The fixing hole 12 extends in a direction orthogonal to the hole axis L1 of the holding hole 6 and penetrates from one flat portion 2*e* of the rod-shaped member 2 to the holding hole 6. In the present embodiment, the fixing hole 12 extends in the orthogonal direction V.

(Brush-Shaped Grinder)

As illustrated in FIG. 6, the grinding element bundle holder 5 has a sleeve 21 surrounding an end of the seated portion 4*a* of the grinding element bundle 4 from the outer peripheral side, and a bottom 22 closing one opening of the sleeve 21. The sleeve 21 has a cylindrical shape. The bottom 22 has a disk-like shape. An end of the grinding element bundle 4 abuts on the bottom 22. The grinding element bundle 4 is fixed to the grinding element bundle holder 5 by adhesive. The bottom 22 has a threaded hole 23. The threaded hole 23 penetrates the bottom 22. One opening 23*a* and the other opening 23*b* of the threaded hole 23 are 180° apart from each other in the circumferential direction of the bottom 22.

The grinding element bundle 4 is a bundle of a plurality of wire-shaped grinding elements 3. Each of the wire-shaped grinding element 3 is formed by impregnating and hardening an assembly of inorganic filaments with resin. In other words, the wire-shaped grinding element 3 includes an assembly of inorganic filaments and a resin with which the assembly is impregnated. In addition to alumina fibers, silicon carbide fibers, boron fibers, glass fibers, or the like can be used as the inorganic filaments. In the present embodiment, the inorganic filaments are alumina fibers. The wire-shaped grinding element 3 can be made of nylon, abrasive grain-containing nylon, abrasive grain-containing rubber, stainless steel, or brass.

The grinding element bundle 4 is bundled in a circular shape in accordance with the shape of the sleeve 21 of the grinding element bundle holder 5. In the present embodiment, the tip end 4*c* of the grinding element bundle 4 (the tip end 4*c* of the protruding portion) has a conical shape tapered toward the tip end.

(Attachment of Brush-Shaped Grinder to Holding Hole)

Figure 7:
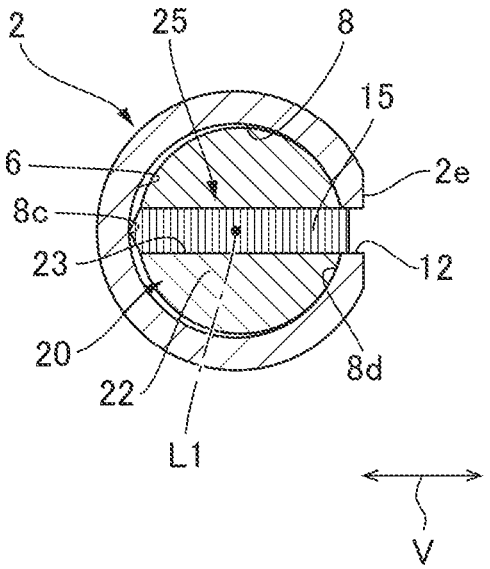
FIG. 7 is an illustration of a screw fixing mechanism for fixing the brush-shaped grinder to the rod-shaped member.

FIG. 7 is an illustration of a screw fixing mechanism for fixing the brush-shaped grinder 20 to the rod-shaped member 2. In FIG. 7, the holding hole 6 is cut perpendicularly to the hole axis L1. As illustrated in FIGS. 1 and 2, the brush-shaped grinder 20 is held in the rod-shaped member 2 with the grinding element bundle holder 5 inserted in the holding hole 6. The brush-shaped grinder 20 is fixed to the rod-shaped member 2 by a screw fixing mechanism 25 in a non-rotatable manner around the hole axis L1 of the holding hole 6.

As illustrated in FIG. 7, the screw fixing mechanism 25 includes a fixing screw 15, the threaded hole 23 provided at the bottom 22, and the fixing hole 12 provided in the rod-shaped member 2. The fixing screw 15 has a cylindrical shape and has male threads on the outer peripheral surface. The threaded hole 23 penetrates the bottom 22 in a direction orthogonal to the hole axis L1 of the holding hole 6. The fixing hole 12 extends in a direction orthogonal to the hole axis L1 of the holding hole 6 and penetrates from one flat portion 2*e* of the rod-shaped member 2 to the holding hole 6. In the present embodiment, the fixing hole 12 extends in the orthogonal direction V.

The fixing screw 15 is screwed into the threaded hole 23 through the fixing hole 12 and penetrates the bottom 22 of the grinding element bundle holder 5. Thus, the end of the fixing screw 15 on the side opposite to the fixing hole 12 protrudes from the bottom 22. The tip end of the fixing screw 15 therefore abuts on a peripheral wall portion 8*c* located on the side opposite to the fixing hole 12 in the peripheral wall 8. When the fixing screw 15 is further screwed in with the tip end of the fixing screw 15 in abutment with the peripheral wall portion 8*c*, the grinding element bundle holder 5 is pressed against a peripheral wall portion 8*d* including the opening edge of the fixing hole 12 in the peripheral wall 8. The brush-shaped grinder 20 is thus fixed to the rod-shaped member 2.

As illustrated in FIG. 5, with the grinding element bundle holder 5 held in the holding hole 6, the bottom 22 abuts on the bottom face 7 of the holding hole 6. The sleeve 21 is in contact with the peripheral wall 8 of the holding hole 6. Here, the hole axis L1 of the holding hole 6 extends in the inclination direction S. Therefore, when the grinding element bundle holder 5 is held in the holding hole 6, the grinding element bundle 4 extends in the inclination direction S. Thus, the protruding portion 4*b* of the grinding element bundle 4 extending outward from the opening 6*a* in the holding hole 6 protrudes toward the front side X1 in the inclination direction S.

As illustrated in FIG. 5, with the brush-shaped grinder 20 held in the holding hole 6, a radially outside end 4*d* of the tip end 4*c* of the grinding element bundle 4 is inclined to the back side X2 toward the outer peripheral side at an angle smaller than 30° relative to the axis L0.

Furthermore, with the brush-shaped grinder 20 held in the holding hole 6, the peripheral wall 8 of the holding hole 6 has a peripheral wall portion 8*a* facing the seated portion 4*a* of the grinding element bundle 4 from the radially inside of the rod-shaped member 2 with respect to the hole axis L1 of the holding hole 6. In the present embodiment, the peripheral wall portion 8*a* faces the seated portion 4*a* of the grinding element bundle 4 from the front side X1. An opening-side region 8*b* with a predetermined width from the opening in the peripheral wall portion 8*a* faces the seated portion 4*a* with a gap.

The opening-side region 8*b* is a region extending from the opening 6*a* of the holding hole 6 to the sleeve 21 of the grinding element bundle holder 5 in the peripheral wall portion 8*a*. In other words, the opening-side region 8*b* is a region facing a portion exposed from the grinding element bundle holder 5 in the seated portion 4*a*. Here, the opening-side region 8*b* of the peripheral wall portion 8*a* and the seated portion 4*a* of the grinding element bundle 4 are spaced apart from each other by a dimension corresponding to the thickness of the sleeve 21. In other words, in the present embodiment, the inner diameter size of the inner peripheral wall of the holding hole 6 is constant. Furthermore, with the brush-shaped grinder 20 held in the holding hole 6, the sleeve 21 of the grinding element bundle holder 5 is in contact with the peripheral wall portion 8*a* facing the brush-shaped grinder 20 from the front side X1 in the holding hole 6. Therefore, when the brush-shaped grinder 20 is held in the holding hole 6, the portion exposed from the grinding element bundle holder 5 in the seated portion 4*a* of the grinding element bundle 4 faces the region extending from the opening 6*a* of the holding hole 6 to the sleeve 21 of the grinding element bundle holder 5 (opening-side region 8*b*) in the peripheral wall portion 8*a*, with a gap with a dimension corresponding to the thickness of the sleeve 21.

To hold the brush-shaped grinder 20 in the holding hole 6, the rod-shaped member 2 is gripped with a jig so that the rod-shaped member 2 attains a predetermined posture. After that, the brush-shaped grinder 20 is held in the holding hole 6 from a predetermined direction. In other words, the front end face 2*b* of the rod-shaped member 2 and the front inner wall 10*a* of the recess 10 are parallel to each other. The front end face 2*b* and the front inner wall 10*a* are therefore used to grip a section between the front end face 2*b* and the front inner wall 10*a* with a jig. Thus, the rod-shaped member 2 is gripped with a jig in a predetermined posture. The brush-shaped grinder 20 thus can be held in the holding hole 6 of the rod-shaped member 2, using an automatic instrument or the like.

The rod-shaped member 2 has the small-diameter hole 9 extending from the bottom face 7 of the holding hole 6 to the side opposite to the opening 6*a* and penetrating the rod-shaped member 2. The air in the holding hole 6 therefore escapes to the outside through the small-diameter hole 9 when the brush-shaped grinder 20 is held in the holding hole 6. Thus, the grinding element bundle 4 can be easily held in the holding hole 6.

As illustrated in FIG. 5, when the rod-shaped member 2 is viewed from the orthogonal direction V, the dimension M1 of the opening-side region 8*b* in the direction along the hole axis L1 is equal to or greater than the diameter M2 of the grinding element bundle 4. In other words, the dimension M1 of the region in which the grinding element bundle 4 is spaced apart from the peripheral wall portion 8*a* of the holding hole 6 inside the holding hole 6 is equal to or greater than the diameter M2 of the grinding element bundle 4.

(Polishing Method)

Figure 8:
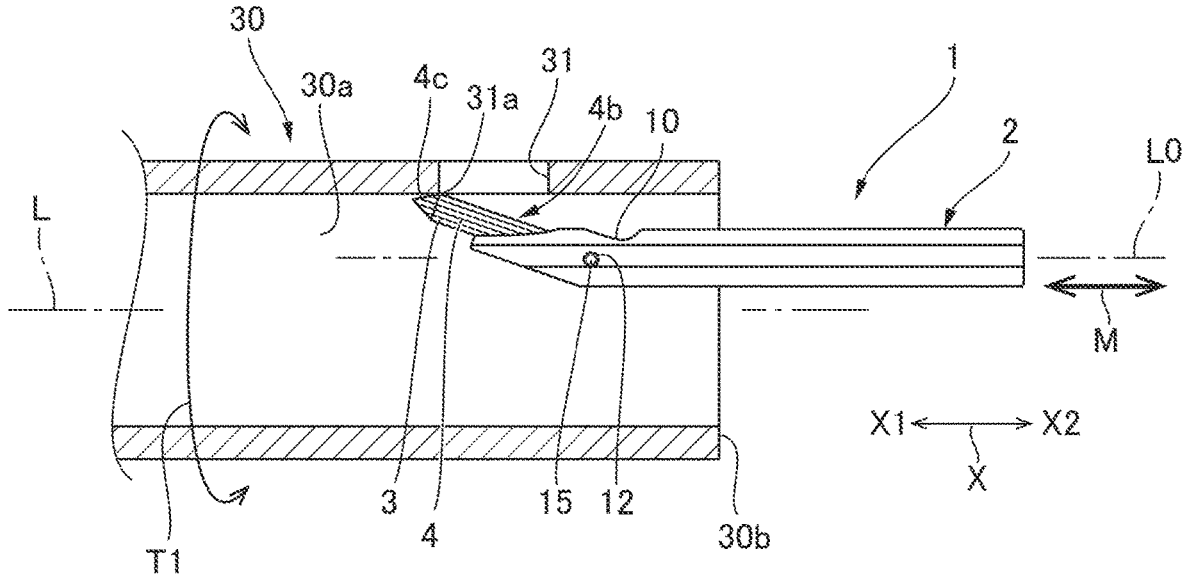
FIG. 8 is an illustration of a polishing method using the polishing brush.

FIG. 8 is an illustration of a polishing method using the polishing brush 1. In the following example, the workpiece is an elongated tube member 30 (tubular portion). The tube member 30 has an opening 31 penetrating in a direction intersecting the tube axis L at the middle of the member axial direction. In FIG. 8, the tube member 30 is illustrated in cross section along the tube axis L. Burrs occur at an opening edge 31*a* of the opening 31 in an inner peripheral surface 30*a* of the tube member 30. The polishing brush 1 is used in the polishing work to remove the burrs.

To polish the inner peripheral surface 30*a* of the tube member 30 with the polishing brush 1, the tube axis L of the tube member 30 is set parallel to the axis L0 of the rod-shaped member 2, and the grinding element bundle 4 is inserted into the tube member 30. The tip end 4*c* of the grinding element bundle 4 is then brought into contact with the inner peripheral surface 30*a*. When or after the tip end 4*c* of the grinding element bundle 4 is brought into contact with the inner peripheral surface 30*a*, the tube member 30 is rotated around the tube axis L as indicated by arrow T1. Then, as indicated by arrow M, the polishing brush 1 is moved in the axial direction X, if necessary.

In the polishing work, air and/or coolant is supplied from the back opening 11*a* of the internal channel 11, if necessary. The air and/or coolant is thus provided toward the grinding element bundle 4 through the front opening 11*b* of the internal channel 11 and the recess 10.

Here, the tip end 4*c* of the grinding element bundle 4 protrudes outward from the rod-shaped member 2 when viewed from the direction of the axis L0. The rod-shaped member 2 does not have a portion protruding to the outer peripheral side from the back end face 2*c* when viewed from the direction of the axis L0. Therefore, the axis L0 of the rod-shaped member 2 is set parallel to the tube axis L of the tube member 30, whereby the rod-shaped member 2 can be inserted deep into the tube member 30 while avoiding interference between the rod-shaped member 2 and an opening edge 30*b* of the tube member 30. The polishing brush 1 thus can polish the depth of the inner peripheral surface 30*a* of the tube member 30.

Since the grinding element bundle 4 is inclined relative to the axis L0, the grinding element bundle 4 is flexed in a direction approaching the axis L0 when the tip end 4*c* of the grinding element bundle 4 is brought into contact with the inner peripheral surface 30*a* of the tube member 30 during the polishing work. The inner peripheral surface 30*a* of the tube member 30 therefore can be polished using the shape-returning force of the grinding element bundle 4. The flexing of the grinding element bundle 4 can prevent or suppress excessive grinding of the inner peripheral surface 30*a* of the tube member 30 with the grinding element bundle 4.

Here, the inclination angle θ1 at which the hole axis L1 and the axis L0 intersect is 20°. In other words, the inclination angle θ1 at which the grinding element bundle 4 held in the holding hole 6 is inclined relative to the axis L0 is 20°. In the present embodiment, since the inclination angle θ1 is 45° or less, the grinding element bundle 4 is easily flexed toward the axis L0 when the tip end 4*c* of the grinding element bundle 4 is brought in contact with the inner peripheral surface 30*a* of the tube member 30. In the present embodiment, since the inclination angle θ1 is 30° or less, the grinding element bundle 4 can be flexed more easily. Furthermore, since the inclination angle θ1 is 45° or less, the tip end 4*c* of the grinding element bundle 4 easily reaches the depth of the tube member 30. Since the inclination angle θ1 is 15° or more, the tip end 4*c* of the grinding element bundle 4 is easily brought into contact with the inner peripheral surface 30*a* of the tube member 30 located on the outer peripheral side of the rod-shaped member 2.

Furthermore, the peripheral wall 8 of the holding hole 6 has the peripheral wall portion 8*a* facing the seated portion 4*a* of the grinding element bundle 4 from the radially inside of the rod-shaped member 2 with respect to the hole axis L1. In other words, the holding hole 6 has the peripheral wall portion 8*a* facing the seated portion 4*a* of the grinding element bundle 4 from the front side X1. The peripheral wall portion 8*a* therefore can limit the range of flexure of the grinding element bundle 4 even when the grinding element bundle 4 is flexed in the direction approaching the axis L0 under the load applied to the grinding element bundle 4 from the inner peripheral surface 30*a* of the tube member 30. The grinding element bundle 4 thus can maintain the polishing force to polish the inner peripheral surface 30*a* of the tube member 30.

If the peripheral wall portion 8*a* of the holding hole 6 is in contact with the seated portion 4*a* of the grinding element bundle 4, the grinding element bundle 4 is easily broken from the portion abutting on the opening edge of the holding hole 6 when the grinding element bundle 4 is flexed under the load applied to the grinding element bundle 4 from the inner peripheral surface 30*a* of the tube member 30. In comparison, in the present embodiment, the opening-side region 8*b* with a predetermined width from the opening in the peripheral wall portion 8*a* faces the seated portion 4*a* of the grinding element bundle 4 with a gap. The grinding element bundle 4 is therefore allowed to flex inside the holding hole 6 when load is applied to the grinding element bundle 4 from the inner peripheral surface 30*a* of the tube member 30. This configuration can prevent or suppress the breakage of the grinding element bundle 4 from the portion abutting on the edge of the opening 6*a* of the holding hole 6. In the present embodiment, the dimension M1 of the opening-side region 8*b* in the direction along the hole axis L1 is equal to or greater than the diameter M2 of the grinding element bundle 4. The grinding element bundle 4 is therefore easily allowed to flex inside the holding hole 6.

In the present embodiment, the tip end 4*c* of the grinding element bundle 4 has a conical shape tapered toward the tip end. In this configuration, the radially outside end 4*d* of the grinding element bundle 4 is inclined to the back side X2 toward the outer peripheral side at an angle smaller than 30° relative to the axis L0 when viewed from a direction perpendicular to the virtual plane N including the hole axis L1 and the axis L0. The tip end 4*c* of the grinding element bundle 4 therefore can be brought into contact with the inner peripheral surface 30*a* over a wide area from the beginning of polishing when the inner peripheral surface 30*a* of the tube member 30 is polished. Here, since it is easy to form the tip end 4*c* of the grinding element bundle 4 into a conical shape, according to the present embodiment, the production of the grinding element bundle 4 with an inclined tip end is easy.

The brush-shaped grinder 20 is fixed to the rod-shaped member 2 by the screw fixing mechanism 25 in a non-rotatable manner around the hole axis L1 of the holding hole 6. The brush-shaped grinder 20 therefore does not rotate around the hole axis L1 during polishing. The inner peripheral surface 30*a* of the tube member 30 therefore can be polished more precisely than when the brush-shaped grinder 20 held in the holding hole 6 rotates around the hole axis L1 inside the holding hole 6.

(Replacement of Brush-Shaped Grinder)

The brush-shaped grinder 20 is removably attached to the rod-shaped member 2. The brush-shaped grinder 20 therefore can be replaced when the grinding element bundle 4 is worn due to the polishing work.

In replacement of the brush-shaped grinder 20, a pin is inserted through the opening 9*a* of the small-diameter hole 9 after the fixation by the fixing screw 15 is released. The pin is then projected from the bottom face 7 of the holding hole 6 into the interior of the holding hole 6. This operation pushes the grinding element bundle holder 5 toward the opening 6*a* of the holding hole 6. The polishing brush 1 therefore can be disengaged from the holding hole 6 even when the brush-shaped grinder 20 is stuck in the holding hole 6.

When the grinding element bundle 4 is worn, the brush-shaped grinder 20 is rotated 180° around the hole axis L1 so that the unworn portion of the grinding element bundle 4 can be brought into abutment with the tube member 30. More specifically, when the grinding element bundle 4 is worn, the fixing screw 15 is pulled out through one opening 23*a* of the threaded hole 23 of the grinding element bundle holder 5, and the brush-shaped grinder 20 is rotated 180° around the hole axis L1. After that, the fixing screw 15 is screwed into the threaded hole 23 through the other opening 23*b*. With this operation, the polishing brush 1 is fixed to the rod-shaped member 2 in such a posture that the unworn portion of the grinding element bundle 4 faces radially outward. Thus, the same brush-shaped grinder 20 can be used again to polish the inner peripheral surface 30*a* of the tube member 30.

(Modification of Polishing Method)

Figure 9:
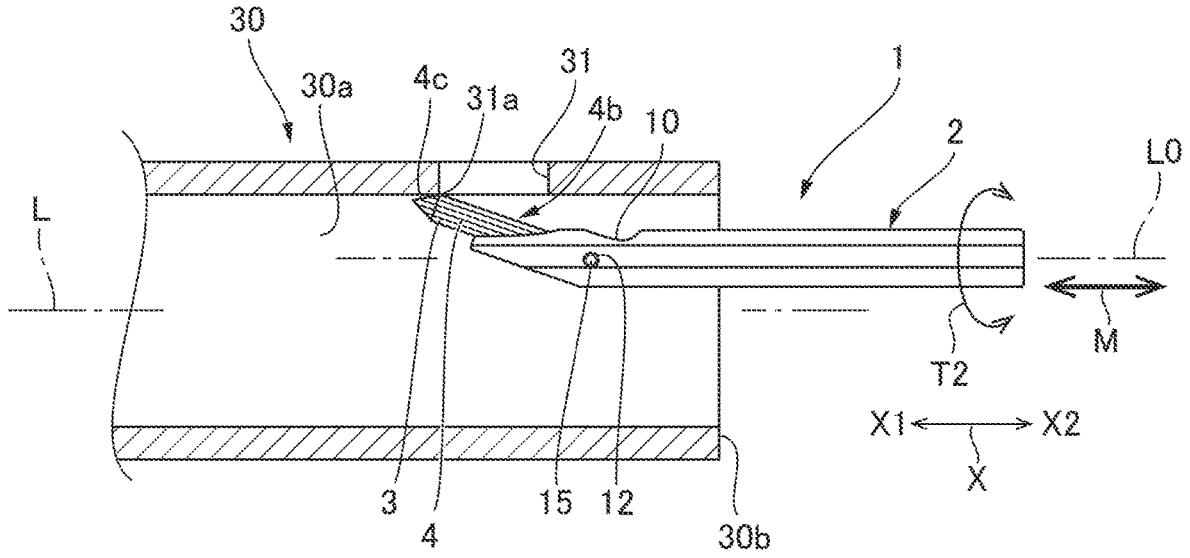
FIG. 9 is an illustration of the polishing method in a modification.

FIG. 9 is an illustration of the polishing method in a modification. As illustrated in FIG. 9, in the polishing method in the modification, first, the axis L0 of the rod-shaped member 2 of the polishing brush 1 is set parallel to the tube axis L of the tube member 30, and the grinding element bundle 4 is inserted into the tube member 30. The tip end 4*c* of the grinding element bundle 4 is then brought into contact with the inner peripheral surface 30*a*. When or after the tip end 4*c* of the grinding element bundle 4 is brought into contact with the inner peripheral surface 30*a*, the polishing brush 1 is rotated around the tube axis L of the rod-shaped member 2, as indicated by arrow T2. Then, as indicated by arrow M, the polishing brush 1 is moved in the axial direction X, if necessary. In this way, the inner peripheral surface 30*a* of the tube member 30 can be polished in the same manner as in the polishing method illustrated in FIG. 8.

First and Second Modifications

Figure 10:
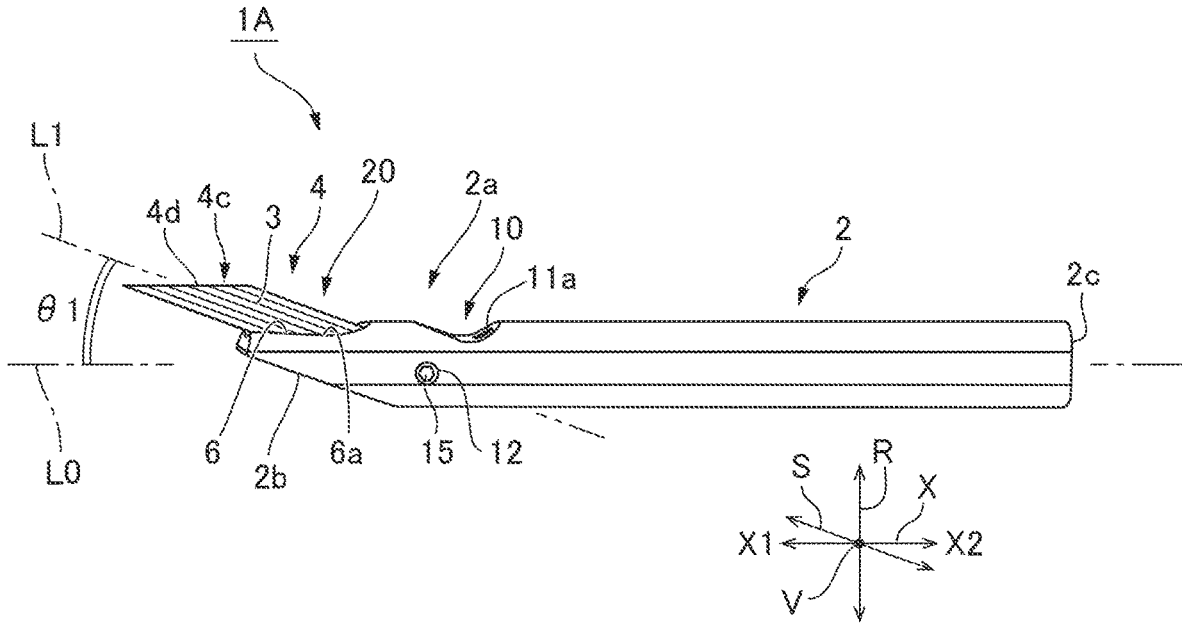
FIG. 10 is an illustration of the polishing brush of a first modification.
Figure 11:
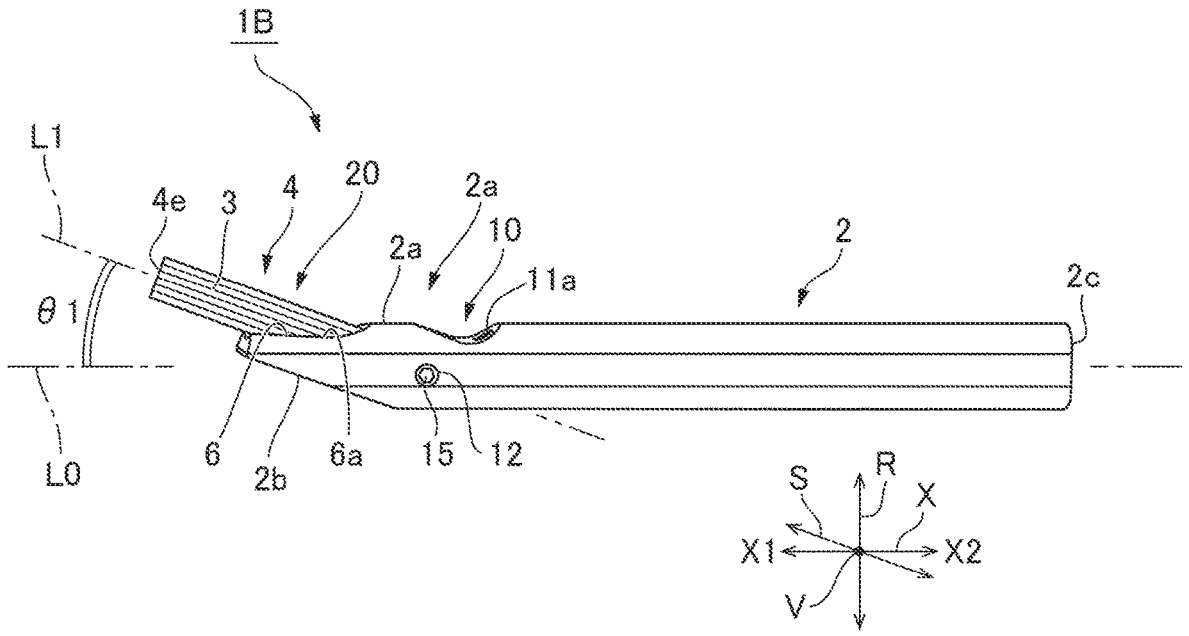
FIG. 11 is an illustration of the polishing brush of a second modification.

FIG. 10 is an illustration of the polishing brush of a first modification. FIG. 11 is an illustration of the polishing brush of a second modification. A polishing brush 1A of the first modification and a polishing brush 1B of the second modification differ from the polishing brush 1 described above in shape of the tip end of the grinding element bundle 4. However, the other configuration is the same as the polishing brush 1 described above. In the following, therefore, the shape of the tip end 4*c* of the grinding element bundle 4 will be described and the other description will be omitted.

As illustrated in FIG. 10, in the polishing brush 1A of the first modification, the radially outside end 4*d* of the grinding element bundle 4 is formed into a flat shape. When viewed from a direction perpendicular to the virtual plane N including the hole axis L1 and the axis L0, the radially outside end 4*d* of the grinding element bundle 4 is parallel to the axis L0. Even in this way, the tip end 4*c* of the grinding element bundle 4 can be brought into contact with the inner peripheral surface 30*a* over a wide area from the beginning of polishing when the inner peripheral surface 30*a* of the tube member 30 is polished.

As illustrated in FIG. 11, in the polishing brush 1B of the second modification, a tip end surface 4*e* of the grinding element bundle 4 is formed into a flat shape perpendicular to the centerline of the grinding element bundle 4. In other words, the tip end surface 4*e* of the grinding element bundle 4 is perpendicular to the hole axis L1 of the holding hole 6. In the present embodiment, the grinding element bundle 4 can be formed by bundling a plurality of wire-shaped grinding elements 3 of the same dimensions. The production of the brush-shaped grinder 20 is therefore easy. In the present embodiment, when the tip end 4*c* of the grinding element bundle 4 becomes worn out due to the polishing of the inner peripheral surface 30*a* of the tube member 30, the tip end 4*c* of the grinding element bundle 4 can be brought into contact with the inner peripheral surface 30*a* over a wide area.

Third Modification

Figure 12:
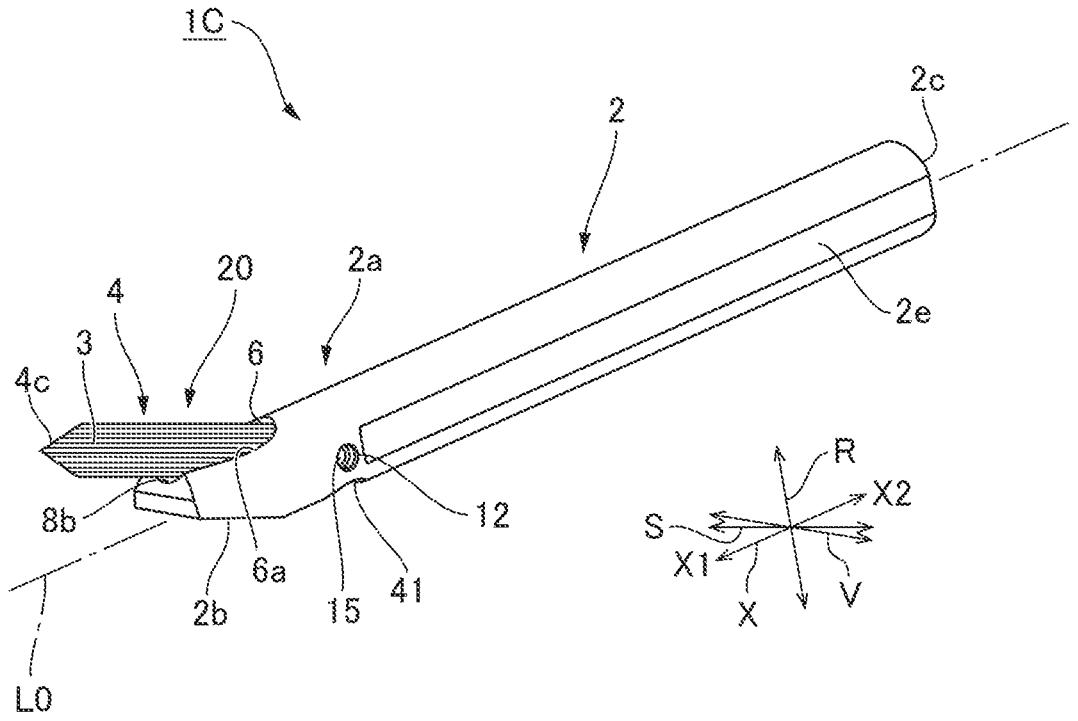
FIG. 12 is a perspective view of the polishing brush of a third modification viewed from the grinding element bundle.
Figure 13:
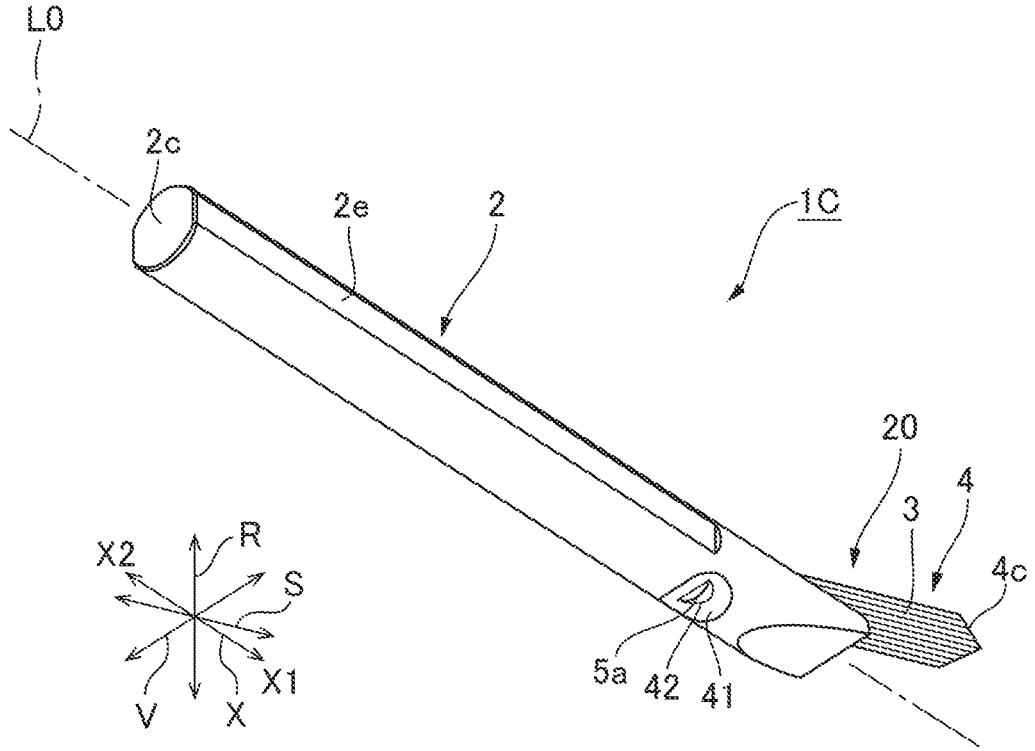
FIG. 13 is a perspective view of the polishing brush of the third modification viewed from the opposite side of FIG. 12.
Figure 14:
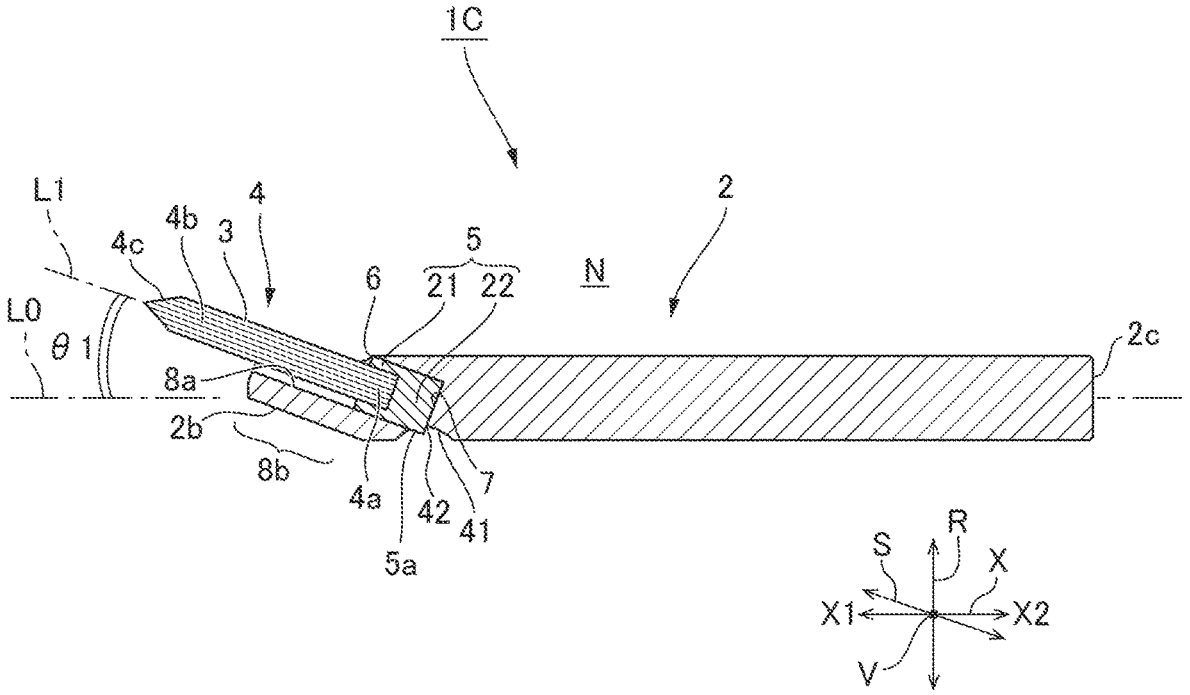
FIG. 14 is a cross-sectional view of the polishing brush of the third modification.

FIG. 12 is a perspective view of the polishing brush of a third modification viewed from the side at which the grinding element bundle 4 protrudes. FIG. 13 is a perspective view of the polishing brush of the third modification viewed from the side opposite to the side at which the grinding element bundle 4 protrudes. FIG. 14 is a cross-sectional view of a polishing brush 1C of the third modification. The polishing brush 1C of the third modification differs from the polishing brush 1 described above in shape of the front portion 2*a* of the rod-shaped member 2, but the other configuration is the same. The shape of the front portion 2*a* of the rod-shaped member 2 will be described and the other description will be omitted. The configuration corresponding to that of the polishing brush 1 will be described with the same reference sign.

As illustrated in FIGS. 12 and 13, in the polishing brush 1C of the present embodiment, the rod-shaped member 2 has a notch 41 on the side opposite to the opening 6*a* of the holding hole 6 across the axis L0. As illustrated in FIG. 14, the holding hole 6 has a second opening 42 at a portion in the circumferential direction of an annular corner at which the peripheral wall 8 and the bottom face 7 intersect. The second opening 42 communicatively connects the holding hole 6 to the outside of the rod-shaped member 2. More specifically, the holding hole 6 has the second opening 42 at the corner of the bottom face 7 and the peripheral wall portion 8*a* facing the seated portion 4*a* of the grinding element bundle 4 from the front side X1. As illustrated in FIG. 13, the second opening 42 is open in the inside of the notch 41. In other words, the second opening 42 is formed on the inner peripheral surface of the notch 41.

Here, the brush-shaped grinder 20 is removably attached to the rod-shaped member 2 by the screw fixing mechanism 25. In the brush-shaped grinder 20 fixed in the holding hole 6, a holder corner 5*a* including a portion in the circumferential direction of the bottom 22 in the grinding element bundle holder 5 is exposed outward of the rod-shaped member 2 from the second opening 42. In the present embodiment, the holder corner 5*a* is exposed outward of the rod-shaped member 2, in the inside of the notch 41. In other words, the holder corner 5*a* does not protrude from the notch 41 to the outer peripheral side of the rod-shaped member 2.

According to the present embodiment, when the brush-shaped grinder 20 is held in the holding hole 6, the air in the holding hole 6 can escape to the outside through the second opening 42. The brush-shaped grinder 20 therefore is easily held in the holding hole 6. When the brush-shaped grinder 20 is held in the holding hole 6, the grinding element bundle holder 5 can be visible through the notch 41 and the second opening 42. Whether the brush-shaped grinder 20 is reliably held in the holding hole 6 therefore can be visually checked. Furthermore, the grinding element bundle holder 5 has the holder corner 5*a* exposed from the rod-shaped member 2 through the notch 41 and the second opening 42. The holder corner 5*a* therefore can be pushed in the inclination direction S from the outside of the rod-shaped member 2. Here, the holder corner 5*a* is pushed in the inclination direction S to move the grinding element bundle holder 5 toward the opening 6*a* of the holding hole 6. The removal of the brush-shaped grinder 20 is therefore easy.

In the present embodiment, the holder corner 5*a* exposed outward of the rod-shaped member 2 is located in the inside of the notch 41. The holder corner 5*a* therefore can be prevented from interfering with the opening edge of the tube member 30 or the like when the polishing brush 1C is inserted into the tube member 30.

In the present embodiment, the rod-shaped member 2 can also have the notched recess 10. The rod-shaped member 2 can also have the internal channel 11 with the front opening 11*b* at the notched recess 10. The present embodiment also can achieve operation effects similar to those of the polishing brush 1C described above.

Second Embodiment

Figure 15:
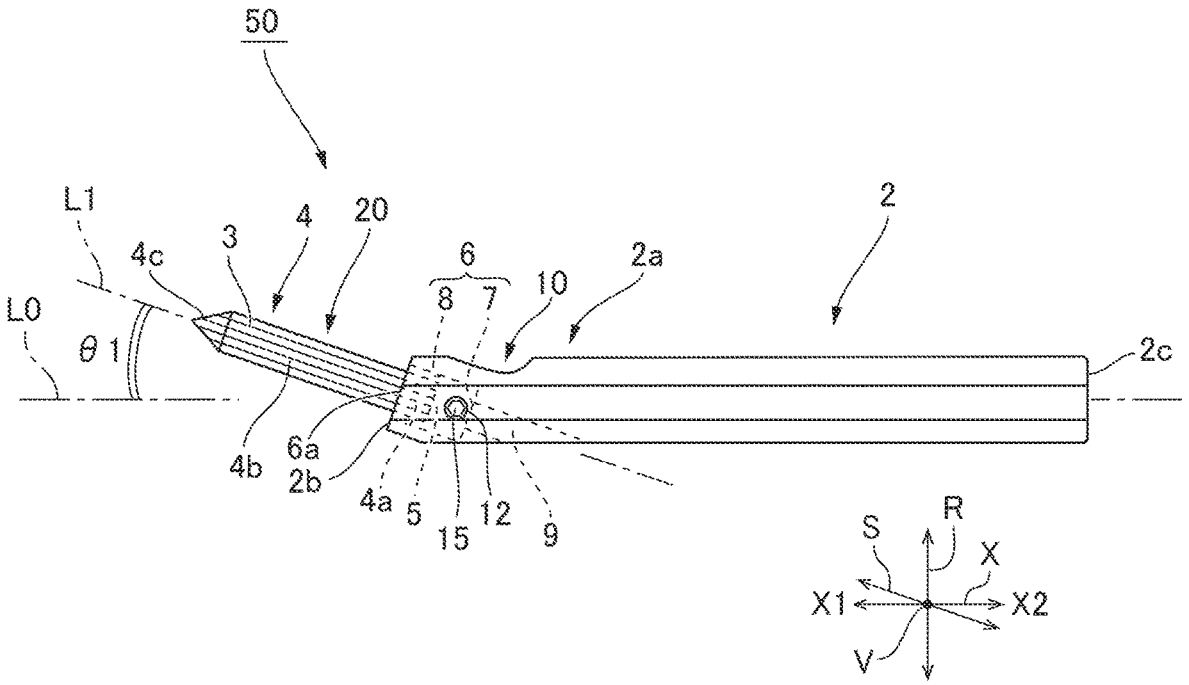
FIG. 15 is an illustration of a polishing brush of a second embodiment.

FIG. 15 is an illustration of a polishing brush of a second embodiment. A polishing brush 50 in the present embodiment has a shape corresponding to the polishing brush 1 described above. The corresponding part is therefore denoted by the same reference sign and will not be further elaborated. In the polishing brush 50 of the second embodiment, the holding hole 6 is provided at the front end of the rod-shaped member 2. In other words, the opening 6*a* of the holding hole 6 is provided at the front end face 2*b* of the rod-shaped member 2. The holding hole 6 is recessed in the inclination direction S from the front end face 2*b*. The holding hole 6 has the bottom face 7 and the sleeve-shaped peripheral wall 8 extending from the bottom face 7 in the inclination direction S. The end of the peripheral wall 8 on the side opposite to the bottom face 7 is the opening 6*a*. The opening 6*a* is formed at the front end face 2*b* of the rod-shaped member 2. The opening 6*a* is located on the front side X1 with respect to the bottom face 7. The inner diameter size of the peripheral wall 8 is constant.

The holding hole 6 holds the grinding element bundle holder 5 of the brush-shaped grinder 20. In the present embodiment, the grinding element bundle holder 5 is fitted in the holding hole 6. The portion held by the grinding element bundle holder 5 in the grinding element bundle 4 is therefore the seated portion 4*a* seated in the holding hole 6. The portion exposed from the grinding element bundle holder 5 in the grinding element bundle 4 is the protruding portion 4*b* protruding to the front side from the front end face 2*b* of the rod-shaped member 2.

In the present embodiment, the grinding element bundle 4 held in the holding hole 6 of the rod-shaped member 2 also extends in the inclination direction S. When viewed from the axial direction X, the tip end 4*c* of the protruding portion 4*b* is located on the outside of the rod-shaped member 2.

Therefore, to polish the inner peripheral surface 30*a* of the tube member 30, the tip end 4*c* of the grinding element bundle 4 can be brought into contact with the inner peripheral surface 30*a* by setting the axis L0 of the rod-shaped member 2 parallel to the tube axis L of the tube member 30, and inserting the grinding element bundle 4 into the tube member 30. The polishing brush 50 in the present embodiment thus can polish the inner peripheral surface 30*a* of the tube member 30. The holding hole 6 of the rod-shaped member 2 that holds the grinding element bundle 4 is recessed in the inclination direction S. Therefore, when the brush-shaped grinder 20 is held in the holding hole 6, the grinding element bundle 4 can protrude from the opening 6*a* of the holding hole 6 in the inclination direction S.

Third Embodiment

Figure 16:
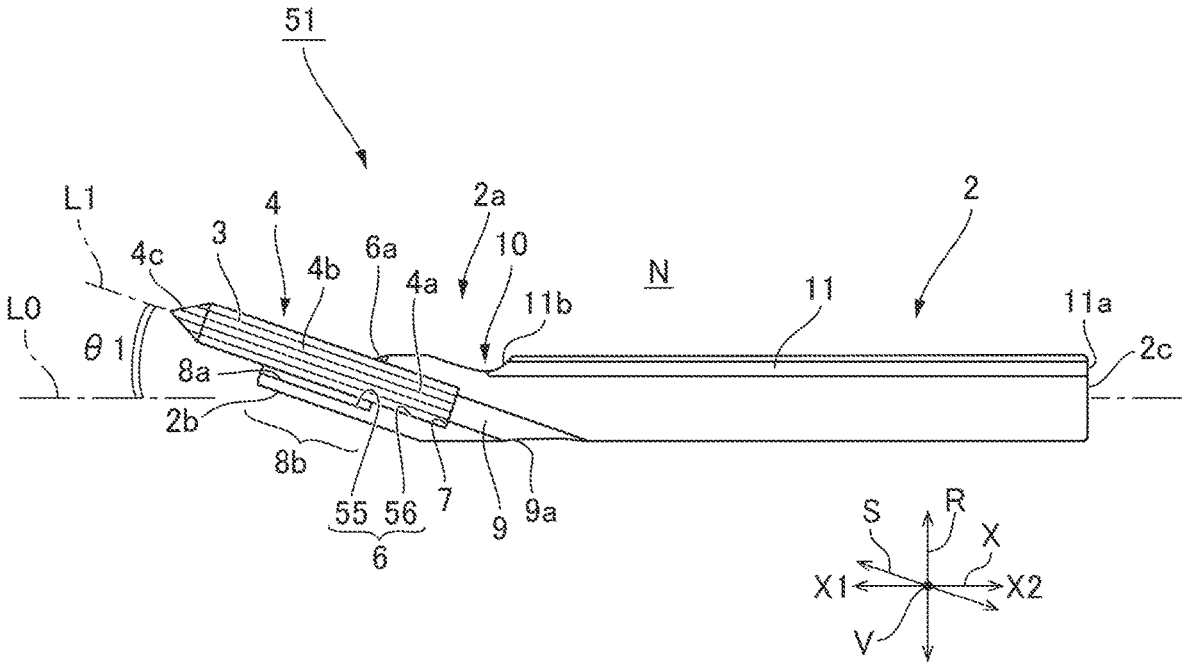
FIG. 16 is an illustration of a polishing brush of a third embodiment.

FIG. 16 is an illustration of a polishing brush of a second embodiment. In a polishing brush 51 of the present embodiment, the grinding element bundle 4 is held directly in the holding hole 6 of the rod-shaped member 2. The polishing brush 51 of the third embodiment has a configuration corresponding to the polishing brush 1, and the corresponding part is therefore denoted by the same reference sign and will not be further elaborated.

As illustrated in FIG. 16, the polishing brush 51 has the rod-shaped member 2 and the grinding element bundle 4 formed of a plurality of wire-shaped grinding elements 3. The grinding element bundle 4 is held in the holding hole 6 provided in the rod-shaped member 2. The grinding element bundle 4 has the seated portion 4*a* seated in the holding hole 6 and the protruding portion 4*b* protruding from the opening 6*a* of the holding hole 6. The protruding portion 4*b* is inclined relative to the axis L0 of the rod-shaped member 2.

The holding hole 6 has a large-diameter hole portion 55 from the opening 6*a* side toward the bottom face 7 and a small-diameter hole portion 56 coaxial with the large-diameter hole portion 55 and having a smaller inner diameter size than the large-diameter hole portion 55. The end of the seated portion 4*a* on the side opposite to the protruding portion 4*b* in the grinding element bundle 4 is inserted into the small-diameter hole portion 56. The end of the seated portion 4*a* on the side opposite to the protruding portion 4*b* in the grinding element bundle 4 is fixed to the small-diameter hole portion 56 by adhesive or the like.

Even in the present embodiment, the peripheral wall 8 of the holding hole 6 has the peripheral wall portion 8*a* facing the seated portion 4*a* of the grinding element bundle 4 from the radially inside of the rod-shaped member 2 with respect to the hole axis L1. In other words, the holding hole 6 has the peripheral wall portion 8*a* facing the seated portion 4*a* of the grinding element bundle 4 from the front side X1. In the peripheral wall portion 8*a*, the opening-side region 8*b* with a predetermined width from the opening 6*a* faces the seated portion 4*a* with a gap. In the present embodiment, the opening-side region 8*b* is the inner peripheral surface of the large-diameter hole portion 55 and is the region facing the seated portion 4*a* of the grinding element bundle 4 from the front side X1.

In the present embodiment, since the grinding element bundle 4 is directly fixed to the rod-shaped member 2, it is not easy to replace the worn grinding element bundle 4 with a new grinding element bundle 4. However, except for this point, the polishing brush 51 in the present embodiment achieves operation effects similar to those of the polishing brush 1 described above. Here, in the present embodiment, the polishing brush 51 does not have the grinding element bundle holder 5. In this respect, the production cost of the polishing brush 51 can be reduced.

Fourth Embodiment

Figure 17:
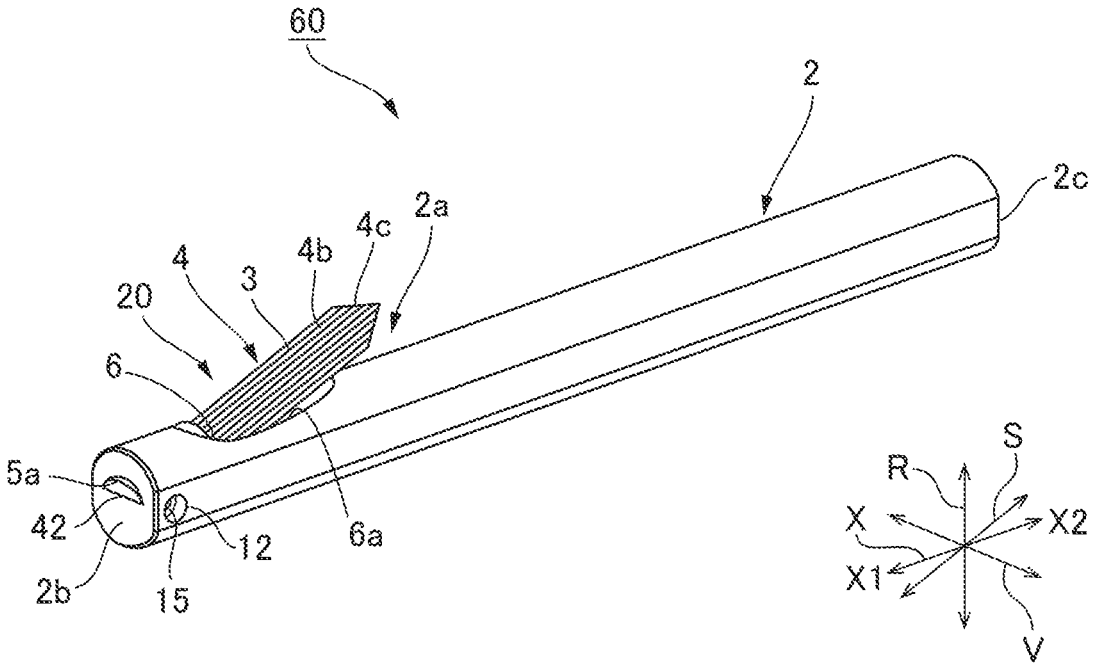
FIG. 17 is a perspective view of a polishing brush of a fourth embodiment viewed from the grinding element bundle.
Figure 18:
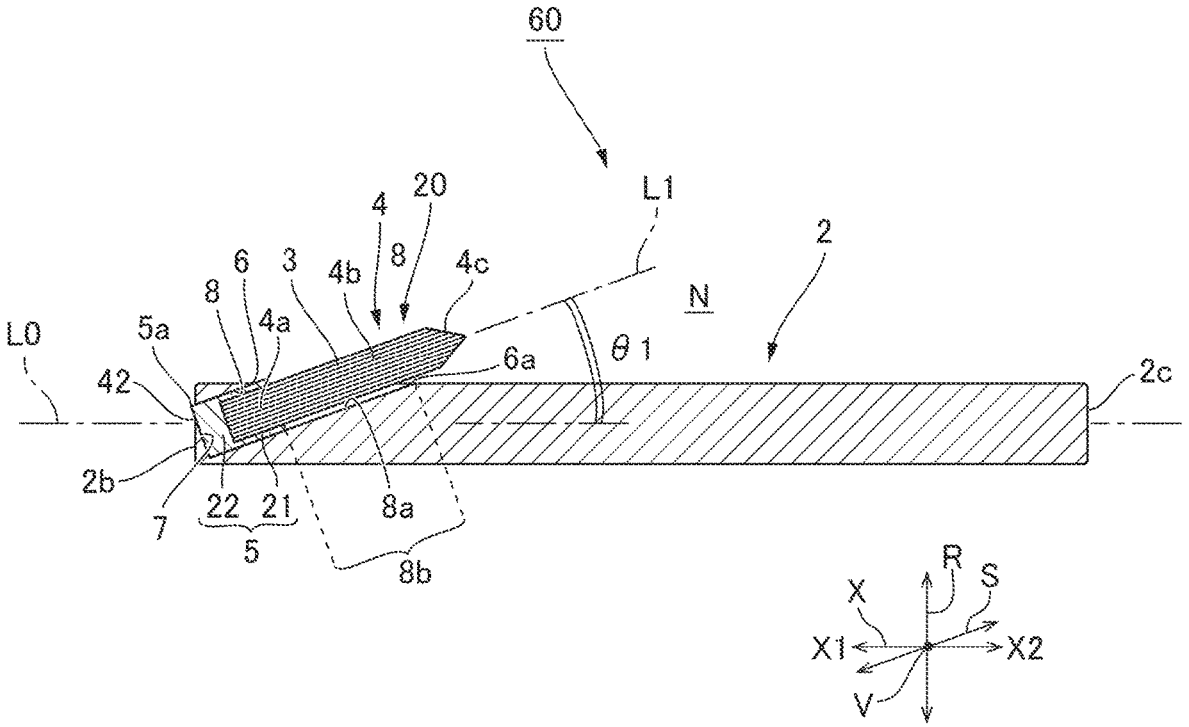
FIG. 18 is a cross-sectional view of the polishing brush of the fourth embodiment.

FIG. 17 is a perspective view of a polishing brush of a fourth embodiment viewed from the grinding element bundle 4. FIG. 18 is a cross-sectional view of the polishing brush of the fourth embodiment. In a polishing brush 60 of the fourth modification, the protruding portion 4*b* of the grinding element bundle 4 extends to the back side X2. The polishing brush 60 of the fourth embodiment has a configuration corresponding to the polishing brush 1 described above, and the corresponding part is therefore denoted by the same reference sign and will not be further elaborated.

As illustrated in FIG. 17, the polishing brush 60 of the present embodiment has the rod-shaped member 2 and the grinding element bundle 4 formed of a plurality of wire-shaped grinding elements 3. The grinding element bundle 4 is held in the holding hole 6 provided at the front portion 2*a* of the rod-shaped member 2. The grinding element bundle 4 has the seated portion 4*a* seated in the holding hole 6 and the protruding portion 4*b* protruding from the opening 6*a* of the holding hole 6. The grinding element bundle 4 extends in the inclination direction S intersecting the axial direction X and the radial direction R. In the present embodiment, the protruding portion 4*b* is inclined from the opening 6*a* of the holding hole 6 to the back side X2 toward the outer peripheral side. When viewed from the axial direction X, the tip end 4*c* of the protruding portion 4*b* is located on the outside of the rod-shaped member 2.

As illustrated in FIG. 18, the end opposite to the protruding portion 4*b* in the seated portion 4*a* is held by the grinding element bundle holder 5. The grinding element bundle 4 is removably held in the holding hole 6 with the grinding element bundle holder 5 interposed. The grinding element bundle 4 and the grinding element bundle holder 5 constitute the brush-shaped grinder 20. The rod-shaped member 2 therefore removably holds the brush-shaped grinder 20 in the holding hole 6. The brush-shaped grinder 20 is the same as the brush-shaped grinder 20 of the polishing brush 1 described above.

Here, the holding hole 6 provided in the rod-shaped member 2 has the bottom face 7 and the sleeve-shaped peripheral wall 8 extending from the bottom face 7 in the inclination direction S. The holding hole 6 therefore extends in the inclination direction S. The bottom face 7 is orthogonal to the inclination direction S. The end of the peripheral wall 8 on the side opposite to the bottom face 7 is the opening 6*a* of the holding hole 6. In the present embodiment, the opening 6*a* of the holding hole 6 is located on the back side X2 with respect to the bottom face 7. The inner diameter size of the peripheral wall 8 is constant. Here, the hole axis L1 extends in the inclination direction S. The inclination angle θ1 at which the hole axis L1 intersects the axis L0 of the rod-shaped member 2 is 15° or more and 45° or less. In the present embodiment, the inclination angle θ1 is 20°.

As illustrated in FIG. 17, the front end face 2*b* of the rod-shaped member 2 is a plane perpendicular to the axis L0. The rod-shaped member 2 has the fixing hole 12 between the front end face 2*b* and the opening 6*a* in the axial direction X. The fixing hole 12 is communicatively connected to the holding hole 6. The fixing hole 12 extends in a direction orthogonal to the hole axis L1 of the holding hole 6. In the present embodiment, the fixing hole 12 extends in the orthogonal direction V perpendicular to the virtual plane N including the axis L0 and the hole axis L1.

Here, as illustrated in FIG. 18, the holding hole 6 has the second opening 42 at a portion in the circumferential direction of an annular corner at which the peripheral wall 8 and the bottom face 7 intersect. The second opening 42 communicatively connects the holding hole 6 to the outside of the rod-shaped member 2. In the present embodiment, the holding hole 6 has the second opening 42 at the corner of the bottom face 7 and the portion located on the opening 6*a* side with respect to the axis L0 of the rod-shaped member in the peripheral wall 8. As illustrated in FIG. 17, the second opening 42 is open at the front end face 2*b* of the rod-shaped member 2.

(Attachment of Brush-Shaped Grinder to Holding Hole)

As illustrated in FIG. 18, the brush-shaped grinder 20 is held in the rod-shaped member 2 with the grinding element bundle holder 5 inserted in the holding hole 6. The brush-shaped grinder 20 is fixed to the rod-shaped member 2 by the screw fixing mechanism 25 in a non-rotatable manner around the hole axis L1 of the holding hole 6. In other words, the fixing screw 15 of the screw fixing mechanism 25 is screwed into the threaded hole 23 of the grinding element bundle holder 5 through the fixing hole 12 of the rod-shaped member 2. The fixing screw 15 has a cylindrical shape and has male threads on the outer peripheral surface.

With the grinding element bundle holder 5 held in the holding hole 6, the bottom 22 abuts on the bottom face 7 of the holding hole 6. The sleeve 21 is in contact with the peripheral wall 8 of the holding hole 6. Here, the hole axis L1 of the holding hole 6 extends in the inclination direction S. Therefore, when the grinding element bundle holder 5 is held in the holding hole 6, the grinding element bundle 4 extends in the inclination direction S. Thus, the protruding portion 4*b* extending outward from the opening 6*a* in the holding hole 6 protrudes toward the back side X2 in the inclination direction S.

With the brush-shaped grinder 20 held in the holding hole 6, the radially outside end of the tip end 4*c* of the grinding element bundle 4 is inclined to the front side X1 toward the outer peripheral side at an angle smaller than 30° relative to the axis L0.

With the brush-shaped grinder 20 held in the holding hole 6, the peripheral wall 8 of the holding hole 6 has the peripheral wall portion 8*a* facing the seated portion 4*a* of the grinding element bundle 4 from the radially inside of the rod-shaped member 2 with respect to the hole axis L1 of the holding hole 6. In the present embodiment, the peripheral wall portion 8*a* faces the seated portion 4*a* of the grinding element bundle 4 from the back side X2. The opening-side region 8*b* with a predetermined width from the opening in the peripheral wall portion 8*a* faces the seated portion 4*a* with a gap.

The opening-side region 8*b* is a region extending from the opening 6*a* of the holding hole 6 to the sleeve 21 of the grinding element bundle holder 5 in the peripheral wall portion 8*a*. In other words, the opening-side region 8*b* is a region facing a portion exposed from the grinding element bundle holder 5 in the seated portion 4*a*. Here, the opening-side region 8*b* of the peripheral wall portion 8*a* and the seated portion 4*a* of the grinding element bundle 4 are spaced apart from each other by a dimension corresponding to the thickness of the sleeve 21. In other words, in the present embodiment, the inner diameter size of the inner peripheral wall of the holding hole 6 is constant. With the brush-shaped grinder 20 held in the holding hole 6, the sleeve 21 of the grinding element bundle holder 5 is in contact with the peripheral wall portion 8*a* facing the brush-shaped grinder 20 from the back side X2 in the holding hole 6. Therefore, when the brush-shaped grinder 20 is held in the holding hole 6, the portion exposed from the grinding element bundle holder 5 in the seated portion 4*a* of the grinding element bundle 4 faces the region extending from the opening 6*a* of the holding hole 6 to the sleeve 21 of the grinding element bundle holder 5 (opening-side region 8*b*) in the peripheral wall portion 8*a*, with a gap with a dimension corresponding to the thickness of the sleeve 21.

With the brush-shaped grinder 20 held in the holding hole 6, the holder corner 5*a* including a portion in the circumferential direction of the bottom 22 in the grinding element bundle holder 5 is exposed outward of the rod-shaped member 2 from the second opening 42. In the present embodiment, the holder corner 5*a* protrudes from the rod-shaped member 2 to the front side X1. The holder corner 5*a* therefore does not protrude to the outer peripheral side of the rod-shaped member 2 when the polishing brush 60 is viewed from the axial direction X.

(Polishing Method)

Figure 19:
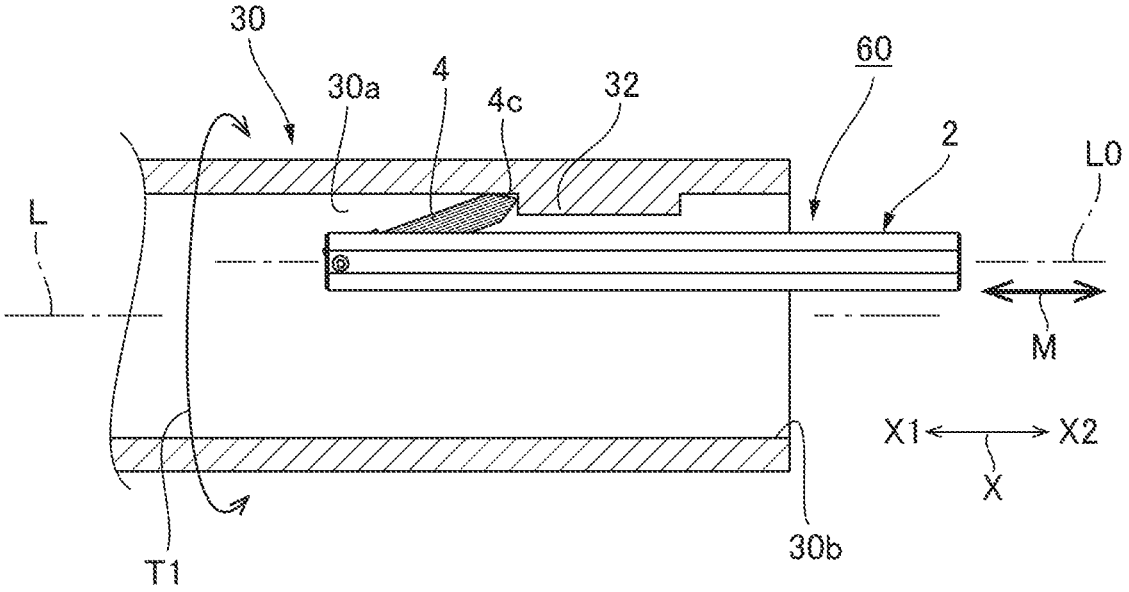
FIG. 19 is an illustration of a polishing method using the polishing brush of the fourth embodiment.

FIG. 19 is an illustration of a polishing method using the polishing brush 60 of the fourth embodiment. Even with the polishing brush 60 of the present embodiment, the inner peripheral surface 30*a* of the tube member 30 can be polished by the polishing method illustrated in FIGS. 8 and 9. When the polishing brush 60 of the present embodiment is used, as illustrated in FIG. 19, a step 32 on the inner peripheral surface 30*a* of the tube member 30 can be polished from the depth side of the tube member 30.

In other words, when the inner peripheral surface 30*a* of the tube member 30 has the step 32, as illustrated in FIG. 19, the axis L0 of the rod-shaped member 2 is set parallel to the tube axis L of the tube member 30, and the polishing brush 60 is inserted into the tube member 30 until the grinding element bundle 4 is located deeper than the step 32. The tip end 4*c* of the grinding element bundle 4 is then brought into contact with the step 32 from the depth side of the tube member 30. When or after the tip end 4*c* of the grinding element bundle 4 is brought into contact with the inner peripheral surface 30*a*, the tube member 30 is rotated around the tube axis L as indicated by arrow T1. Furthermore, the polishing brush 60 is moved in the axial direction X, as indicated by arrow M, if necessary. When or after the tip end 4*c* of the grinding element bundle 4 is brought into contact with the inner peripheral surface 30*a*, as illustrated in FIG. 9, the polishing brush 60 may be rotated around the axis L0 of the rod-shaped member 2 and, if necessary, the polishing brush 60 may be moved in the axial direction X.

(Operation Effects)

Even in the present embodiment, the tip end 4*c* of the grinding element bundle 4 protrudes outward from the rod-shaped member 2 when viewed from the direction of the axis L0. The rod-shaped member 2 does not have a portion protruding to the outer peripheral side from the back end face 2*c* when viewed from the direction of the axis L0. Therefore, the axis L0 of the rod-shaped member 2 is set parallel to the tube axis L of the tube member 30, whereby the rod-shaped member 2 can be inserted deep into the tube member 30 while avoiding interference between the rod-shaped member 2 and the opening edge 30*b* of the tube member 30. The polishing brush 60 thus can polish the depth of the inner peripheral surface 30*a* of the tube member 30.

In the present embodiment, since the grinding element bundle 4 is inclined relative to the axis L0, the grinding element bundle 4 is flexed in a direction approaching the axis L0 when the tip end 4*c* of the grinding element bundle 4 is brought into contact with the inner peripheral surface 30*a* of the tube member 30 during the polishing work. The inner peripheral surface 30*a* of the tube member 30 therefore can be polished using the shape-returning force of the grinding element bundle 4. The flexing of the grinding element bundle 4 can prevent or suppress excessive grinding of the inner peripheral surface 30*a* of the tube member 30 with the grinding element bundle 4. Here, in the present embodiment, the inclination angle θ1 is 45° or less. The grinding element bundle 4 is therefore easily flexed when the tip end 4*c* of the grinding element bundle 4 comes into contact with the inner peripheral surface 30*a* of the tube member 30.

Furthermore, the peripheral wall 8 of the holding hole 6 has the peripheral wall portion 8*a* facing the seated portion 4*a* of the grinding element bundle 4 from the radially inside of the rod-shaped member 2 with respect to the hole axis L1 of the holding hole 6. In other words, the holding hole 6 has the peripheral wall portion 8*a* facing the seated portion 4*a* of the grinding element bundle 4 from the back side X2. The peripheral wall portion 8*a* therefore can limit the range of flexure of the grinding element bundle 4 even when the grinding element bundle 4 is flexed in the direction approaching the axis L0 under the load applied to the grinding element bundle 4 from the inner peripheral surface 30*a* of the tube member 30. The grinding element bundle 4 thus can maintain the polishing force to polish the inner peripheral surface 30*a* of the tube member 30.

In the present embodiment, the opening-side region 8*b* with a predetermined width from the opening in the peripheral wall portion 8*a* faces the seated portion 4*a* with a gap. The grinding element bundle 4 is therefore allowed to flex inside the holding hole 6 when load is applied to the grinding element bundle 4 from the inner peripheral surface 30*a* of the tube member 30. This configuration can prevent or suppress the breakage of the grinding element bundle 4 from the portion abutting on the opening edge of the holding hole 6.

In the present embodiment, the second opening 42 communicatively connected to the holding hole 6 is provided at the front end face 2*b* of the rod-shaped member 2. The air in the holding hole 6 therefore can escape to the outside through the second opening 42 when the brush-shaped grinder 20 is held in the holding hole 6. Thus, the brush-shaped grinder 20 is easily held in the holding hole 6. When the brush-shaped grinder 20 is held in the holding hole 6, the grinding element bundle holder 5 can be visible through the notch 41 and the second opening 42. Whether the brush-shaped grinder 20 is reliably held in the holding hole 6 therefore can be visually checked.

Furthermore, the grinding element bundle holder 5 has the holder corner 5*a* exposed from the rod-shaped member 2 through the second opening 42. The holder corner 5*a* therefore can be pushed in the inclination direction S from the outside of the rod-shaped member 2. Here, the holder corner 5*a* is pushed in the inclination direction S to move the grinding element bundle holder 5 toward the opening 6*a* of the holding hole 6. The removal of the brush-shaped grinder 20 is therefore easy.

Here, in the present embodiment, the holder corner 5*a* exposed outward from the rod-shaped member 2 protrudes from the front end face 2*d* of the rod-shaped member to the front side X1. The holder corner 5*a* therefore can be prevented from interfering with the opening edge of the tube member 30 or the like when the polishing brush 51 is inserted into the tube member 30.

Even in the present embodiment, the brush-shaped grinder 20 is removably attached to the rod-shaped member 2 by the screw fixing mechanism 25. The brush-shaped grinder 20 therefore does not rotate around the hole axis L1 during polishing. The inner peripheral surface 30*a* of the tube member 30 therefore can be polished more precisely than when the brush-shaped grinder 20 held in the holding hole 6 rotates around the hole axis L1 inside the holding hole 6.

The brush-shaped grinder 20 can be replaced when the grinding element bundle 4 is worn due to polishing. Furthermore, the outer peripheral surface of the bottom 22 of the grinding element bundle holder 5 has one opening 23*a* and the other opening 23*b* of the threaded hole 23 at locations spaced apart from each other 180° in the circumferential direction. Therefore, when the grinding element bundle 4 is worn, the brush-shaped grinder 20 is rotated 180° around the hole axis L1 and reattached to the holding hole 6 so that the unworn portion of the grinding element bundle 4 can be brought into abutment with the inner peripheral surface 30*a* of the tube member 30.

In the present embodiment, the notched recess 10 can also be provided on the back side X2 of an opening 61 of the holding hole 6 in the front portion 2*a* of the rod-shaped member 2. In this case, the rod-shaped member 2 can have the internal channel 11 with the front opening 11*b* at the notched recess 10. In this way, air and/or coolant can be supplied toward the grinding element bundle 4 through the internal channel 11.

The holding hole 6 may have the second opening 42 at the corner of the bottom face 7 and the peripheral wall portion 8*a* facing the seated portion 4*a* of the grinding element bundle 4 from the back side X2. The second opening 42 is communicatively connected to the outside of the rod-shaped member 2 through the notch 41. In this case, the rod-shaped member 2 has the notch 41 on the side opposite to the opening 6*a* of the holding hole 6 across the axis L0, in the same manner as the polishing brush 1C of the third modification. The second opening 42 is open in the inside of the notch 41. In this way, when the brush-shaped grinder 20 is held in the holding hole 6, the holder corner 5*a* including a portion in the circumferential direction of the bottom 22 in the grinding element bundle holder 5 is exposed outward of the rod-shaped member 2 in the inside of the notch 41.

(Another Example of Screw Fixing Mechanism)

Figure 20:
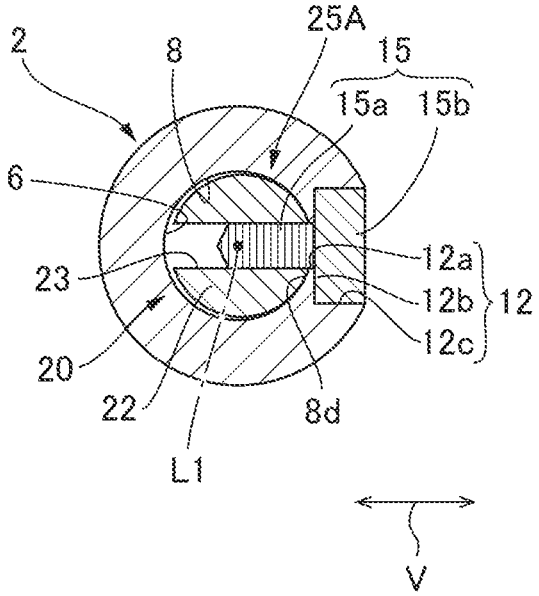
FIG. 20 is an illustration of another example of the screw fixing mechanism.
Figure 21:
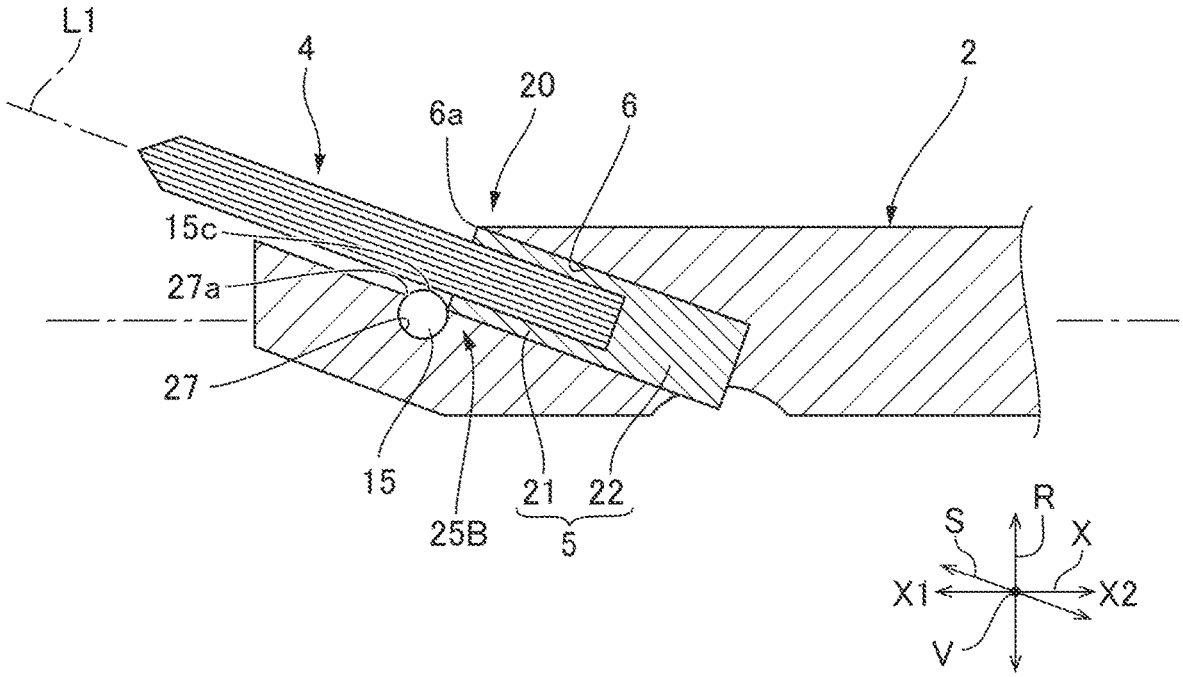
FIG. 21 is an illustration of yet another example of the screw fixing mechanism.
Figure 22:
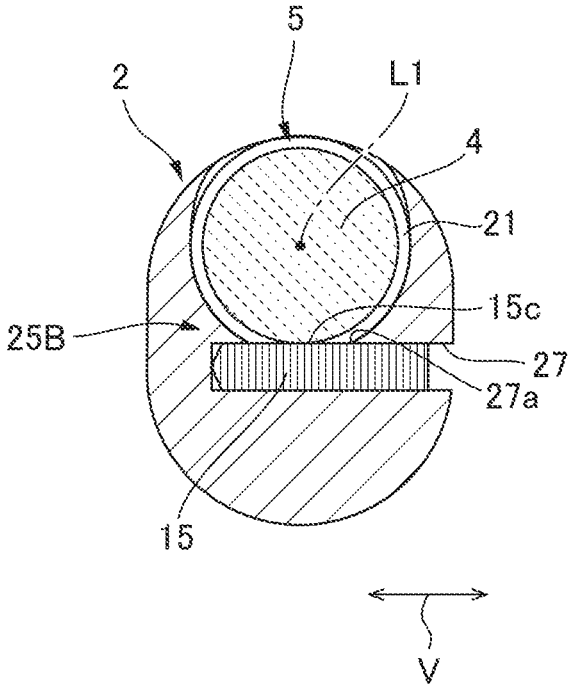
FIG. 22 is an illustration of yet another example of the screw fixing mechanism.

FIG. 20 is an illustration of another example of the screw fixing mechanism. FIGS. 21 and 22 are illustrations of yet another example of the screw fixing mechanism. In FIG. 20, the holding hole 6 is cut perpendicularly to the hole axis L1. In FIG. 21, the vicinity of the holding hole 6 is cut along the axis L0 of the rod-shaped member 2 and the hole axis L1 of the holding hole 6. In FIG. 22, the holding hole 6 is cut diagonally to the hole axis L1.

Each of a screw fixing mechanism 25A illustrated in FIG. 20 and a screw fixing mechanism 25B illustrated in FIGS. 21 and 22 can be used in place of the screw fixing mechanism 25 to fix the brush-shaped grinder 20 in the holding hole 6 of the rod-shaped member 2.

As illustrated in FIG. 20, the screw fixing mechanism 25A includes the fixing screw 15, the threaded hole 23 provided at the bottom 22, and the fixing hole 12 provided in the rod-shaped member 2. The fixing screw 15 has a shaft 15*a* with male threads on the outer peripheral surface to be screwed in the threaded hole 23, and a head 15*b* provided at one end of the shaft 15*a*. The head 15*b* has a larger outer diameter than the shaft 15*a*. The threaded hole 23 penetrates the bottom 22 in a direction orthogonal to the hole axis L1 of the holding hole 6. The fixing hole 12 extends in a direction orthogonal to the hole axis L1 of the holding hole 6 and penetrates from one flat portion 2*e* of the rod-shaped member 2 to the holding hole 6. In the present embodiment, the fixing hole 12 has a small-diameter portion 12*a* having a diameter larger than the shaft 15*a* and smaller than the head 15*b*, and a large-diameter portion 12*b* having an inner diameter larger than the small-diameter portion 12*a* on the outer peripheral side of the small-diameter portion 12*a*. The fixing hole 12 has an annular surface 12*c* between the small-diameter portion 12*a* and the large-diameter portion 12*b*.

The shaft 15*a* of the fixing screw 15 is screwed into the threaded hole 23 through the fixing hole 12. The head 15*b* is seated in the large-diameter portion 12*b*. The head 15*b* abuts on the annular surface 12*c* of the rod-shaped member 2 from the outer peripheral side. With this configuration, the brush-shaped grinder 20 is fixed to the rod-shaped member 2 with the grinding element bundle holder 5 pressed against the peripheral wall portion 8*d* including the opening edge of the fixing hole 12 in the peripheral wall 8.

Even with the screw fixing mechanism 25A of the present embodiment, the brush-shaped grinder 20 is fixed to the rod-shaped member 2 in a non-rotatable manner around the hole axis L1. When the grinding element bundle 4 is worn, the brush-shaped grinder 20 can be rotated 180° around the hole axis L1 and held in the holding hole 6 again. The brush-shaped grinder 20 thus can be reused.

As illustrated in FIGS. 21 and 22, the screw fixing mechanism 25B has the fixing screw 15 and a threaded hole 27 in the rod-shaped member 2. The fixing screw 15 is shaped like a shaft and has male threads on the outer peripheral surface to be screwed into the threaded hole 27. The threaded hole 27 extends in the orthogonal direction V orthogonal to the hole axis L1 of the holding hole 6. The threaded hole 27 has a connecting portion 27*a* communicatively connected to the holding hole 6 at a portion in the circumferential direction of the threaded hole 27. The connecting portion 27*a* is located in the middle of the threaded hole 27 in the orthogonal direction V.

Here, the fixing screw 15 has a protruding portion 15*c* protruding from the connecting portion 27*a* into the holding hole 6 when screwed into the threaded hole 27. The protruding portion 15*c* abuts on the grinding element bundle holder 5 from the opening 6*a* side of the holding hole 6. In other words, the protruding portion 15*c* abuts on the distal end of the sleeve 21 from the opening 6*a* side of the holding hole 6. With this configuration, the brush-shaped grinder 20 is fixed to the rod-shaped member 2 in a non-rotatable manner around the hole axis L1 of the holding hole 6.

Even with the screw fixing mechanism 25B of the present embodiment, the brush-shaped grinder 20 is fixed to the rod-shaped member 2 in a non-rotatable manner around the hole axis L1. When the grinding element bundle 4 is worn, the brush-shaped grinder 20 can be rotated by a desired angle around the hole axis L1 and held in the holding hole 6 again. The brush-shaped grinder 20 thus can be reused.

The invention claimed is:

1. A polishing brush comprising:

a grinding element bundle formed of a plurality of wire-shaped grinding elements; and a rod-shaped member, wherein when a direction along an axis of the rod-shaped member is an axial direction, a direction orthogonal to the axis is a radial direction, a direction intersecting the axial direction and the radial direction is an inclination direction, and one side of the axial direction is a front side and the other side is a back side, the rod-shaped member has a holding hole at a front portion to hold the grinding element bundle, the holding hole has a bottom face, a sleeve-shaped peripheral wall extending from the bottom face in the inclination direction, and an opening facing one direction of the radial direction, the grinding element bundle has a seated portion seated in the holding hole, and a protruding portion protruding from the opening of the holding hole in the inclination direction, an inclination angle at which a hole axis of the holding hole intersects the axis is 45° or less, and a tip end of the protruding portion is located outside of the rod-shaped member when viewed from the axial direction.

2. The polishing brush according to claim 1, wherein the polishing brush comprises one grinding element bundle.

3. The polishing brush according to claim 1, wherein the peripheral wall of the holding hole has a peripheral wall portion facing the seated portion from inside in the radial direction with respect to the hole axis of the holding hole.

4. The polishing brush according to claim 3, wherein an opening-side region with a predetermined width from the opening in the peripheral wall portion faces the seated portion with a gap.

5. The polishing brush according to claim 4, wherein the polishing brush further comprises a grinding element bundle holder to hold an end opposite to the protruding portion of the seated portion, and the grinding element bundle is removably held in the holding hole with the grinding element bundle holder interposed.

6. The polishing brush according to claim 5, wherein the grinding element bundle holder has a sleeve surrounding the end opposite to the protruding portion of the seated portion from an outer peripheral side, and a bottom closing one opening of the sleeve, the bottom abuts on the bottom face, and the sleeve is in contact with the peripheral wall portion on a side closer to the bottom face than the opening-side region.

7. The polishing brush according to claim 6, wherein the polishing brush further comprises a screw fixing mechanism to fix the grinding element bundle holder to the rod-shaped member in a non-rotatable manner around the hole axis of the holding hole.

8. The polishing brush according to claim 7, wherein the sleeve has a cylindrical shape, the bottom has a disk-like shape, the screw fixing mechanism includes a fixing screw, a threaded hole penetrating the bottom in a direction orthogonal to the hole axis of the holding hole, and a fixing hole extending in the direction orthogonal to the hole axis of the holding hole in the rod-shaped member and penetrating from outside of the rod-shaped member to the holding hole, and the fixing screw is screwed into the threaded hole through the fixing hole and penetrates the bottom to abut on the peripheral wall.

9. The polishing brush according to claim 7, wherein the sleeve has a cylindrical shape, the bottom has a disk-like shape, the screw fixing mechanism includes a fixing screw, a threaded hole penetrating the bottom in a direction orthogonal to the hole axis of the holding hole, and a fixing hole extending in the direction orthogonal to the hole axis of the holding hole in the rod-shaped member and penetrating from outside of the rod-shaped member to the holding hole, the fixing screw has a shaft with male threads on an outer peripheral surface to be screwed in the threaded hole, and a head at one end of the shaft, the shaft is screwed into the threaded hole through the fixing hole, and the head abuts on the rod-shaped member from an outer peripheral side.

10. The polishing brush according to claim 7, wherein the sleeve has a cylindrical shape, the screw fixing mechanism includes a fixing screw and a threaded hole extending in a direction orthogonal to the hole axis of the holding hole in the rod-shaped member, the threaded hole has a connecting portion communicatively connected to the holding hole at a portion in a circumferential direction of the threaded hole, the fixing screw has a protruding portion protruding into the holding hole from the connecting portion when the fixing screw is screwed into the threaded hole, and the protruding portion of the fixing screw abuts on the sleeve from an opening side of the holding hole in the inclination direction.

11. The polishing brush according to claim 6, wherein the rod-shaped member has a small-diameter hole having an inner diameter smaller than the holding hole, the small-diameter hole extending linearly from the bottom face to a side opposite to the opening of the holding hole and penetrating the rod-shaped member.

12. The polishing brush according to claim 6, wherein the holding hole has a second opening at a portion in a circumferential direction of an annular corner at which the peripheral wall and the bottom face intersect, the second opening communicatively connecting the holding hole to outside of the rod-shaped member, and a holder corner including a portion in a circumferential direction of the bottom in the grinding element bundle holder is exposed outward of the rod-shaped member through the second opening.

13. The polishing brush according to claim 12, wherein when viewed from an orthogonal direction perpendicular to a virtual plane including the axis and the hole axis of the holding hole, the rod-shaped member has a notch on a side opposite to the opening of the holding hole across the axis, the second opening is open inside of the notch, and the holder corner is located inside of the notch.

14. The polishing brush according to claim 1, wherein the rod-shaped member has a front opening disposed on the back side of the opening at the front portion of the rod-shaped member, a back opening disposed at a back end portion of the rod-shaped member, and an internal channel communicatively connecting the front opening and the back opening.

15. The polishing brush according to claim 1, wherein the protruding portion protrudes to the front side from the opening of the holding hole.

16. The polishing brush according to claim 15, wherein when viewed from an orthogonal direction perpendicular to a virtual plane including the hole axis of the holding hole and the axis, the rod-shaped member has a recess on the back side of the opening at the front portion of the rod-shaped member, a front end face of the rod-shaped member is parallel to the hole axis when viewed from the orthogonal direction, the recess has an inclined surface inclined to a side at which the axis is located from the opening side toward the back side when viewed from the orthogonal direction, and the front end face is parallel to the inclined surface.

17. The polishing brush according to claim 1, wherein the protruding portion protrudes to the back side from the opening of the holding hole.

18. The polishing brush according to claim 1, wherein when viewed from an orthogonal direction perpendicular to a virtual plane including the hole axis of the holding hole and the axis, an outside end of the grinding element bundle is parallel to the axis.

19. The polishing brush according to claim 1, wherein the protruding portion has a tip end with a conical shape tapered in the inclination direction toward the tip end.

20. The polishing brush according to claim 1, wherein an inclination angle at which the hole axis of the holding hole intersects the axis is 15° or more.

21. A polishing method of polishing an inner peripheral surface of a tubular portion in a workpiece using the polishing brush according to claim 1, wherein the grinding element bundle is inserted into the tubular portion with the axis of the rod-shaped member set parallel to a tube axis of the tubular portion, and the workpiece is rotated around the tube axis with the grinding element bundle in contact with the inner peripheral surface.

22. A polishing method of polishing an inner peripheral surface of a tubular portion in a workpiece using the polishing brush according to claim 1, wherein the grinding element bundle is inserted into the tubular portion with the axis of the rod-shaped member set parallel to a tube axis of the tubular portion, and the polishing brush is rotated around the axis with the grinding element bundle in contact with the inner peripheral surface.

* * * * *